US010843017B2

(12) United States Patent
Shively et al.

(10) Patent No.: US 10,843,017 B2
(45) Date of Patent: Nov. 24, 2020

(54) ULTRA HIGH PRESSURE WATER FIRE FIGHTING SYSTEM

(71) Applicant: Oshkosh Defense, LLC, Oshkosh, WI (US)

(72) Inventors: Jason R. Shively, Oshkosh, WI (US); David R. Kay, Appleton, WI (US); Scott A. McComber, Appleton, WI (US); Seth M. Newlin, Appleton, WI (US); John D. Woelfel, Winneconne, WI (US)

(73) Assignee: Oshkosh Defense, LLC, Oshkosh, WI (US)

( * ) Notice: Subject to any disclaimer, the term of this patent is extended or adjusted under 35 U.S.C. 154(b) by 340 days.

(21) Appl. No.: 15/239,698

(22) Filed: Aug. 17, 2016

(65) Prior Publication Data

US 2017/0050063 A1 Feb. 23, 2017

Related U.S. Application Data

(60) Provisional application No. 62/206,730, filed on Aug. 18, 2015.

(51) Int. Cl.

| | |
|---|---|
| ***A62C 27/00*** | (2006.01) |
| ***A62C 33/04*** | (2006.01) |
| ***A62C 35/02*** | (2006.01) |

(52) U.S. Cl.

CPC ..... *A62C 27/00* (2013.01); *A62C 33/04* (2013.01); *A62C 35/026* (2013.01)

(58) Field of Classification Search

CPC ..... A62C 33/04; A62C 35/026; A62C 25/00; A62C 31/00; A62C 35/02; A62C 27/00; F04D 15/0072

USPC ..... 169/24

See application file for complete search history.

(56) References Cited

U.S. PATENT DOCUMENTS

| | | | | |
|---|---|---|---|---|
| 4,189,005 | A * | 2/1980 | McLoughlin | A62C 27/00 169/13 |
| 5,788,158 | A | 8/1998 | Relyea | |
| 5,839,664 | A | 11/1998 | Relyea | |
| 6,860,332 | B1 | 3/2005 | Archer et al. | |

(Continued)

OTHER PUBLICATIONS

Request for Quote No. 12-32106, Available to Applicant as of Jan. 12, 2013.

(Continued)

*Primary Examiner* — Qingzhang Zhou
*Assistant Examiner* — Christopher R Dandridge
(74) *Attorney, Agent, or Firm* — Foley & Lardner LLP

(57) ABSTRACT

A fire fighting vehicle includes a chassis, an engine coupled to the chassis, a fluid tank configured to store a fluid, a fluid delivery system, and a controller. The fluid delivery system includes a first pump, a second pump, a low pressure discharge, a first high pressure discharge, and a second high pressure discharge. The first pump is coupled to the fluid tank and configured to pump the fluid therefrom at a first pressure. The second pump is positioned downstream of and coupled to the first pump in a serial arrangement. The controller is configured to selectively vary at least one of a speed, a power output, and a torque output of the engine and thereby provide the fluid to at least one of the first high pressure discharge and the second high pressure discharge at a target discharge pressure.

14 Claims, 18 Drawing Sheets

(56) References Cited

U.S. PATENT DOCUMENTS

| | | | | |
|---|---|---|---|---|
| 6,883,815 | B2 | 4/2005 | Archer | |
| 7,055,880 | B2 | 6/2006 | Archer | |
| 7,234,534 | B2 | 6/2007 | Froland et al. | |
| 7,387,348 | B2 | 6/2008 | Archer et al. | |
| 7,389,826 | B2 | 6/2008 | Linsmeier et al. | |
| 7,611,075 | B2 | 11/2009 | Relyea et al. | |
| 7,784,554 | B2 * | 8/2010 | Grady | A62C 27/00 169/13 |
| 7,874,373 | B2 | 1/2011 | Morrow et al. | |
| 8,789,614 | B2 * | 7/2014 | Hosfield | A62C 31/00 169/13 |
| 9,008,913 | B1 | 4/2015 | Sears et al. | |
| 9,061,169 | B2 | 6/2015 | Linsmeier | |
| 9,315,210 | B2 | 4/2016 | Sears et al. | |
| 9,399,151 | B1 * | 7/2016 | Combs | A62C 37/00 |
| 9,493,921 | B2 | 11/2016 | Amin et al. | |
| 2006/0021764 | A1 | 2/2006 | Archer et al. | |
| 2006/0022001 | A1 | 2/2006 | Linsmeier et al. | |
| 2006/0266532 | A1 | 11/2006 | Moskun | |
| 2007/0187434 | A1 | 8/2007 | Schrafel | |
| 2007/0284156 | A1 * | 12/2007 | Grady | A62C 27/00 180/53.8 |
| 2008/0099213 | A1 * | 5/2008 | Morrow | A62C 27/00 169/24 |

OTHER PUBLICATIONS

Applicant's Bid Responsive to Request for Quote No. 12-32106, Submitted Feb. 8, 2013.
Request for Quote No. 12-31955, Available to Applicant as of Feb. 15, 2013.
Applicant's Bid Responsive to Request for Quote No. 12-31955, Submitted Mar. 12, 2013.
Request for Quote No. 12-32432, Available to Applicant as of Feb. 15, 2013.
Applicant's Bid Responsive to Request for Quote No. 12-32432, Submitted Mar. 12, 2013.
Request for Quote No. 12-32861, Available to Applicant as of Feb. 15, 2013.
Applicant's Bid Responsive to Request for Quote No. 12-32861, Submitted Mar. 12, 2013.
Request for Quote No. 13-32618, Available to Applicant as of Jan. 7, 2014.
Applicant's Bid Responsive to Request for Quote No. 13-32618, Submitted Feb. 5, 2014.
Request for Quote No. 13-32615, Available to Applicant as of Jan. 14, 2014.
Applicant's Bid Responsive to Request for Quote No. 13-32615, Submitted Feb. 5, 2014.
Request for Quote No. 14-90047, Available to Applicant as of Mar. 12, 2014.
Applicant's Bid Responsive to Request for Quote No. 14-90047, Submitted Apr. 3, 2014.
Request for Quote No. 14-90177, Available to Applicant as of Aug. 12, 2014.
Applicant's Bid Responsive to Request for Quote No. 14-90177, Submitted Aug. 25, 2014.
Request for Quote No. 14-90186, Available to Applicant as of Oct. 22, 2014.
Applicant's Bid Responsive to Request for Quote No. 14-90186, Submitted Oct. 30, 2014.
Request for Quote No. 15-90473, Available to Applicant as of Mar. 16, 2015.
Applicant's Bid Responsive to Request for Quote No. 15-90473, Submitted Apr. 7, 2015.
Request for Quote No. 15-90474, Available to Applicant as of Mar. 16, 2015.
Applicant's Bid Responsive to Request for Quote No. 15-90474, Submitted Apr. 7, 2015.
Request for Quote No. 15-90558, Available to Applicant as of Apr. 16, 2015.
Applicant's Bid Responsive to Request for Quote No. 15-90558, Submitted Apr. 30, 2015.
Request for Quote No. 15-90562, Available to Applicant as of May 26, 2015.
Applicant's Bid Responsive to Request for Quote No. 15-90562, Submitted Jun. 22, 2015.
Request for Quote No. 15-90563, Available to Applicant as of May 26, 2015.
Applicant's Bid Responsive to Request for Quote No. 15-90563, Submitted Jun. 23, 2015.
Request for Quote No. 15-70685, Available to Applicant as of Oct. 20, 2015.
Applicant's Bid Responsive to Request for Quote No. 15-70685, Submitted Nov. 5, 2015.
Request for Quote No. 16-70350, Available to Applicant as of Feb. 12, 2016.
Applicant's Bid Responsive to Request for Quote No. 16-70350, Submitted Mar. 4, 2016.
Request for Quote No. 16-70357, Available to Applicant as of Mar. 5, 2016.
Applicant's Bid Responsive to Request for Quote No. 16-70357, Submitted Mar. 24, 2016.
Pictures of Fire Apparatus Having an Ultra-High Pressure Firefighting System and Delivered by Applicant As Early As Oct. 16, 2015.
Applicant's Bid for Rapid Intervention Vehicles Having an Ultra-High Pressure Firefighting System, Submitted Jun. 11, 2009.
"New Vehicle Affects Future of Air Force Firefighting," Published Jun. 23, 2011, available at https://www.af. mil/News/Article-Display/Article/1 12991/new-vehicle-affects-future-of-air-force-firefighting/.
"New Fire Truck Introduced to Air Force," Published Apr. 16, 2012, available at https://www.columbus.af.mil/News/Article-Display/Article/353472/new-fire-truck-introduced-to-air-force/.

* cited by examiner

ULTRA HIGH PRESSURE WATER FIRE FIGHTING SYSTEM

CROSS-REFERENCE TO RELATED PATENT APPLICATIONS

This application claims the benefit of U.S. Provisional Patent Application No. 62/206,730, filed Aug. 18, 2015, which is incorporated herein by reference in its entirety.

BACKGROUND

Fire fighting vehicles such as Aircraft Rescue Fire Fighting ("ARFF") vehicles are specially designed to respond to airport ground emergencies (e.g., involving an aircraft). Airport ground emergencies may occur anywhere on or near airport property. Water and other agents (e.g., foam fire suppressants) is transported to the emergency site to be applied and facilitate extinguishment.

SUMMARY

One exemplary embodiment relates to a fire fighting vehicle. The fire fighting vehicle includes a chassis, an engine coupled to the chassis, a fluid tank configured to store a fluid, a fluid delivery system, and a controller. The fluid delivery system includes a first pump, a second pump, a low pressure discharge, a first high pressure discharge, and a second high pressure discharge. The first pump is coupled to the fluid tank and configured to pump the fluid therefrom at a first pressure. The second pump is positioned downstream of and coupled to the first pump in a serial arrangement. The second pump is selectively driven by the engine to increase the pressure of the fluid from the first pressure to a second pressure, the second pressure greater than the first pressure. The low pressure discharge is coupled to the first pump. The first high pressure is discharge coupled to the second pump. The second high pressure discharge is coupled to the second pump. The controller is configured to selectively vary at least one of a speed, a power output, and a torque output of the engine based on a mode of operation of at least one of the fire fighting vehicle and the fluid delivery system and thereby provide the fluid to at least one of the first high pressure discharge and the second high pressure discharge at a target discharge pressure.

Another exemplary embodiment relates to a fluid delivery system for a fire fighting vehicle. The fluid delivery system includes a low pressure discharge, a low pressure pump having an inlet configured to receive a fluid from a fluid tank of the fire fighting vehicle and an outlet coupled to the low pressure discharge, a high pressure pump having an inlet coupled to the outlet of the low pressure pump such that the low pressure pump and the high pressure pump are arranged in a serial configuration, and at least one of a turret and a hose reel coupled to an outlet of the high pressure pump. The high pressure pump is configured to be selectively driven by an engine of the fire fighting vehicle. The fluid delivery system is selectively reconfigurable between a first mode of operation and a second mode of operation, the high pressure pump is configured to provide a fluid output to the at least one of the turret and the hose reel during the first mode of operation, and the low pressure pump is configured to provide a fluid output to the low pressure discharge during the second mode of operation.

Still another exemplary embodiment relates to a vehicle. The vehicle includes a frame, an engine coupled to the frame, a fluid reservoir coupled to the frame and configured to store a fluid, a first pump coupled to the fluid reservoir and configured to pump the fluid therefrom at a first pressure, a second pump coupled to the first pump, and a plurality of fluid discharges including (i) a structural discharge coupled to the first pump and (ii) at least one of a hose reel and a turret coupled to the second pump. The second pump is configured to provide the fluid at the second pressure to the at least one of the turret and the hose reel during a first mode of operation, and the first pump is configured to provide the fluid at the first pressure to the structural discharge during a second mode of operation.

The invention is capable of other embodiments and of being carried out in various ways. Alternative exemplary embodiments relate to other features and combinations of features as may be recited herein.

BRIEF DESCRIPTION OF THE DRAWINGS

The disclosure will become more fully understood from the following detailed description, taken in conjunction with the accompanying figures, wherein like reference numerals refer to like elements, in which.

DETAILED DESCRIPTION

Figure 1:
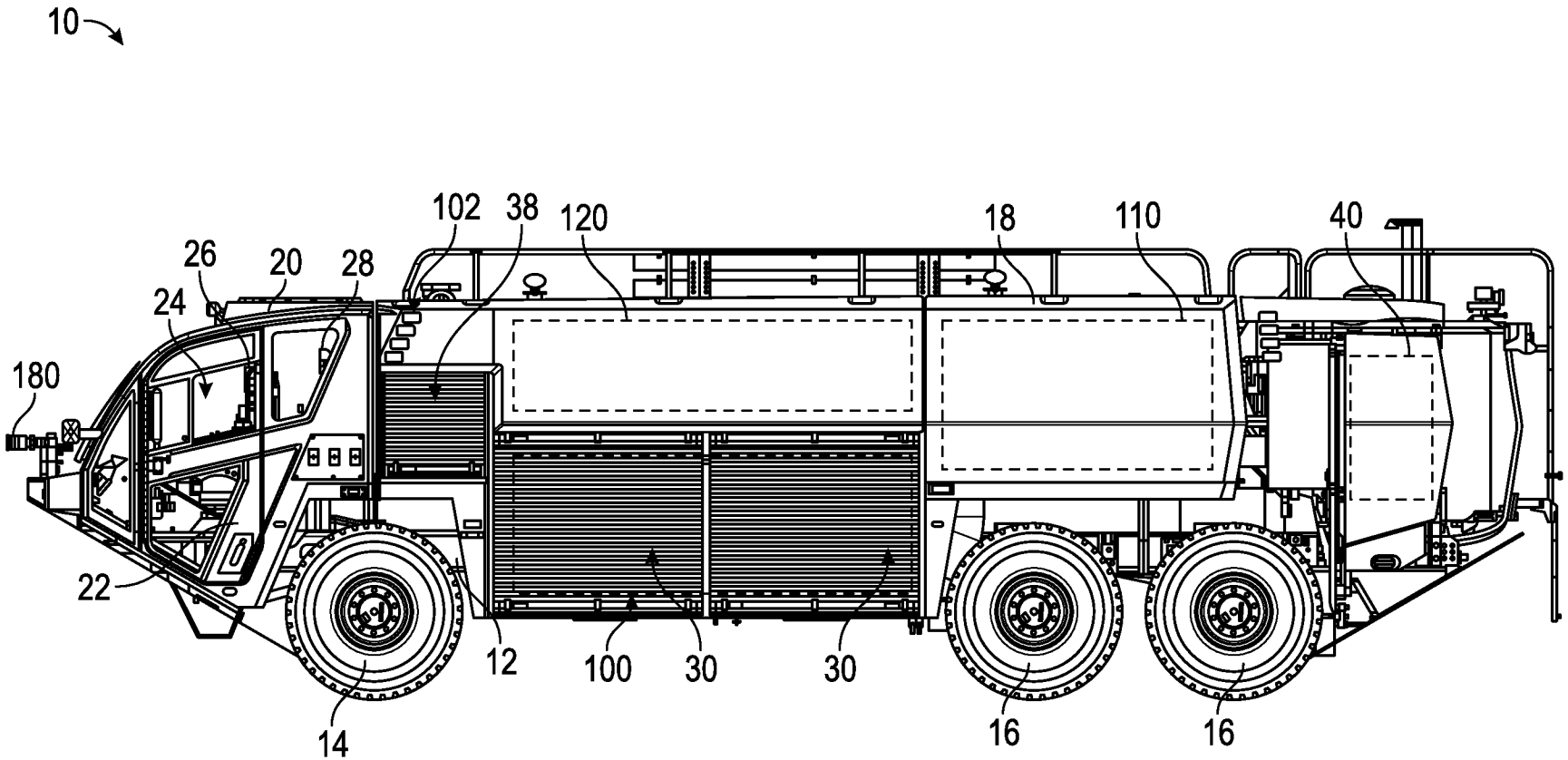
FIG. 1 is a left plan view of a fire fighting vehicle, according to an exemplary embodiment.

Before turning to the figures, which illustrate the exemplary embodiments in detail, it should be understood that the present application is not limited to the details or methodology set forth in the description or illustrated in the figures. It should also be understood that the terminology is for the purpose of description only and should not be regarded as limiting.

Referring generally to the figures, various embodiments of an ultra high pressure pumping system are shown and described. Fire fighting vehicles, for example Aircraft Rescue Fire Fighting (ARFF) vehicles, are specialized vehicles that carry water and foam with them to the scene of an emergency. Although the present Application specifically references ARFF vehicles, it should be understood that the scope of this present Application encompasses any vehicle having an ultra high pressure pumping system. Most commonly, ARFF vehicles are commissioned for use at an airfield, where the location of an emergency (e.g., an airplane crash, etc.) can widely vary, thereby prompting the transport of fire fighting materials to the emergency site. ARFF vehicles are heavy duty vehicles in nature and are able to respond at high speeds to reach even remote areas of an airfield quickly. ARFF vehicles may also operate in various modes including a structural mode (e.g., a low pressure mode, etc.), a crash mode (e.g., an ultra high pressure mode, etc.), a pump and roll mode (e.g., the ultra high pressure mode while driving, etc.), and a driving mode (e.g., movement with the pumping system off, etc.).

According to the exemplary embodiment shown in FIGS. 1-12, a vehicle, shown as fire fighting vehicle 10, includes a pumping system (e.g., a fluid delivery system, etc.), shown as ultra high pressure ("UHP") pumping system 100. According to an exemplary embodiment, the UHP pumping system 100 is configured to provide (e.g., pump, etc.) a fluid (e.g., water, etc.) and/or an agent (e.g., foam, etc.) to aid in extinguishing a fire with at least one of an ultra high pressure when operating in a first mode (e.g., ultra-high pressure mode, pump and roll mode, crash mode, etc.) and a low pressure when operating in a second mode (e.g., low pressure mode, structural mode, etc.). According to the exemplary embodiment shown in FIGS. 1-5, the fire fighting vehicle 10 is an ARFF vehicle. According to alternative embodiments, the fire fighting vehicle 10 is a municipal fire fighting vehicle, a forest fire apparatus, an aerial truck, a rescue truck, a tanker, or still another type of fire fighting vehicle. According to still other embodiments, the vehicle is another type of vehicle (e.g., a military vehicle, a commercial vehicle, etc.).

As shown in FIGS. 1-5, the fire fighting vehicle 10, includes a chassis, shown as a frame 12. The frame 12 supports a plurality of tractive elements, shown as front wheels 14 and rear wheels 16; a body assembly, shown as a rear section 18; and a cab, shown as front cabin 20. In one embodiment, the fire fighting vehicle 10 is a Striker® 6×6 with one front axle to support the front wheels 14 and two rear axles to support the rear wheels 16 manufactured by Oshkosh Corporation®. In other embodiments, the fire fighting vehicle 10 is a Striker® 4×4, a Striker® 1500, a Striker® 3000, or a Striker® 4500 model manufactured by Oshkosh Corporation®. Thus, the fire fighting vehicle 10 may include a different number of front axles and/or rear axles to support the front wheels 14 and the rear wheels 16 based on the application or model of the fire fighting vehicle 10. In an alternative embodiment, the tractive elements are otherwise structured (e.g., tracks, etc.).

Figure 2:
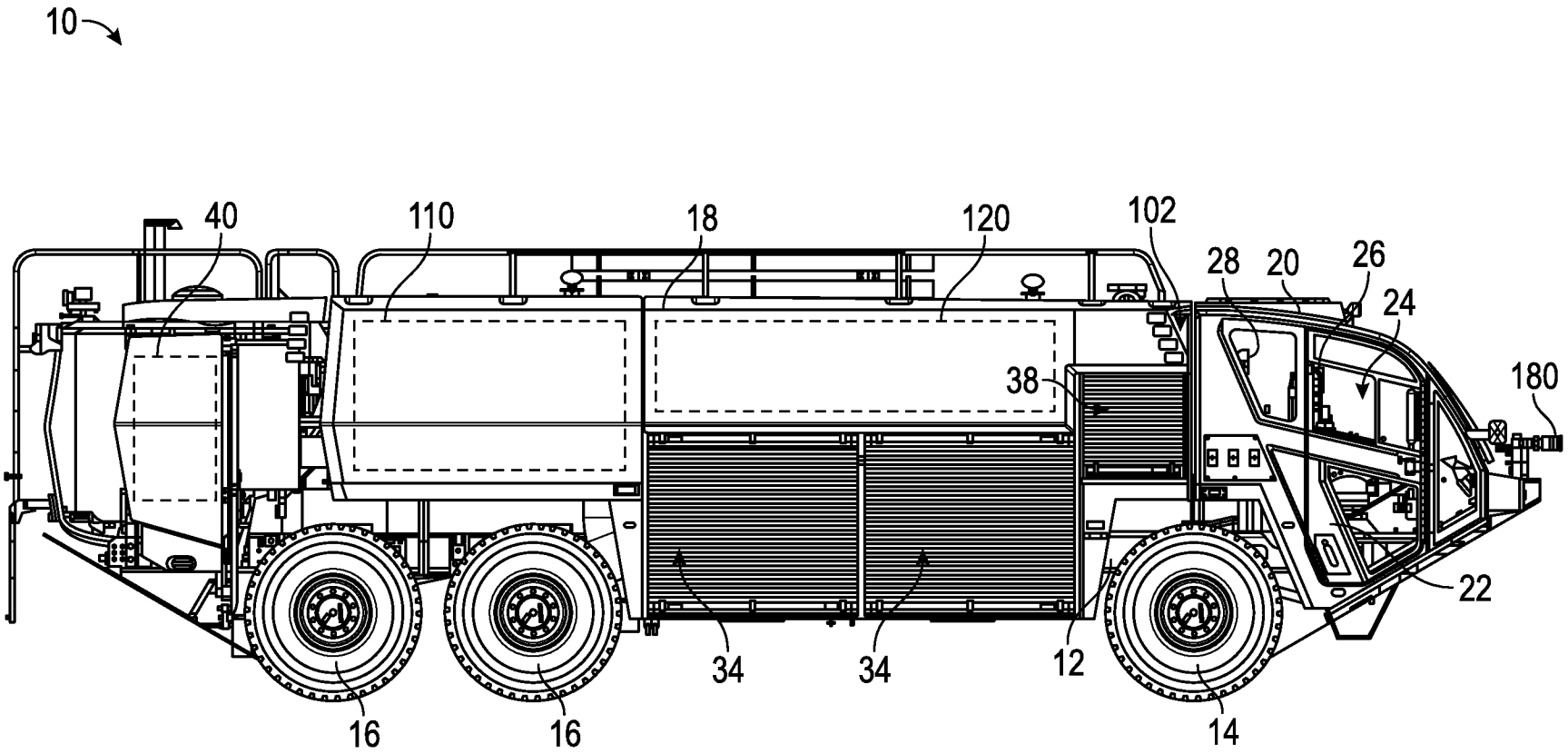
FIG. 2 is a right plan view of a fire fighting vehicle, according to an exemplary embodiment.
Figure 3:
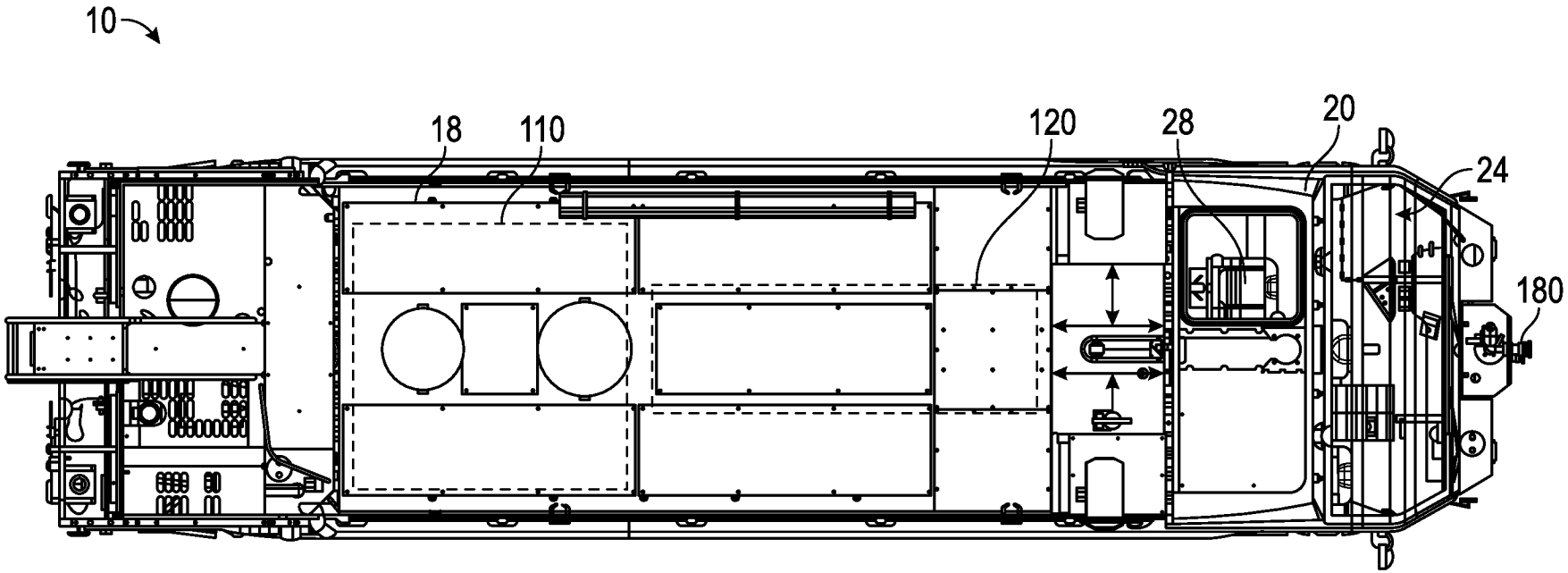
FIG. 3 is a top plan view of a fire fighting vehicle, according to an exemplary embodiment.
Figure 4A:
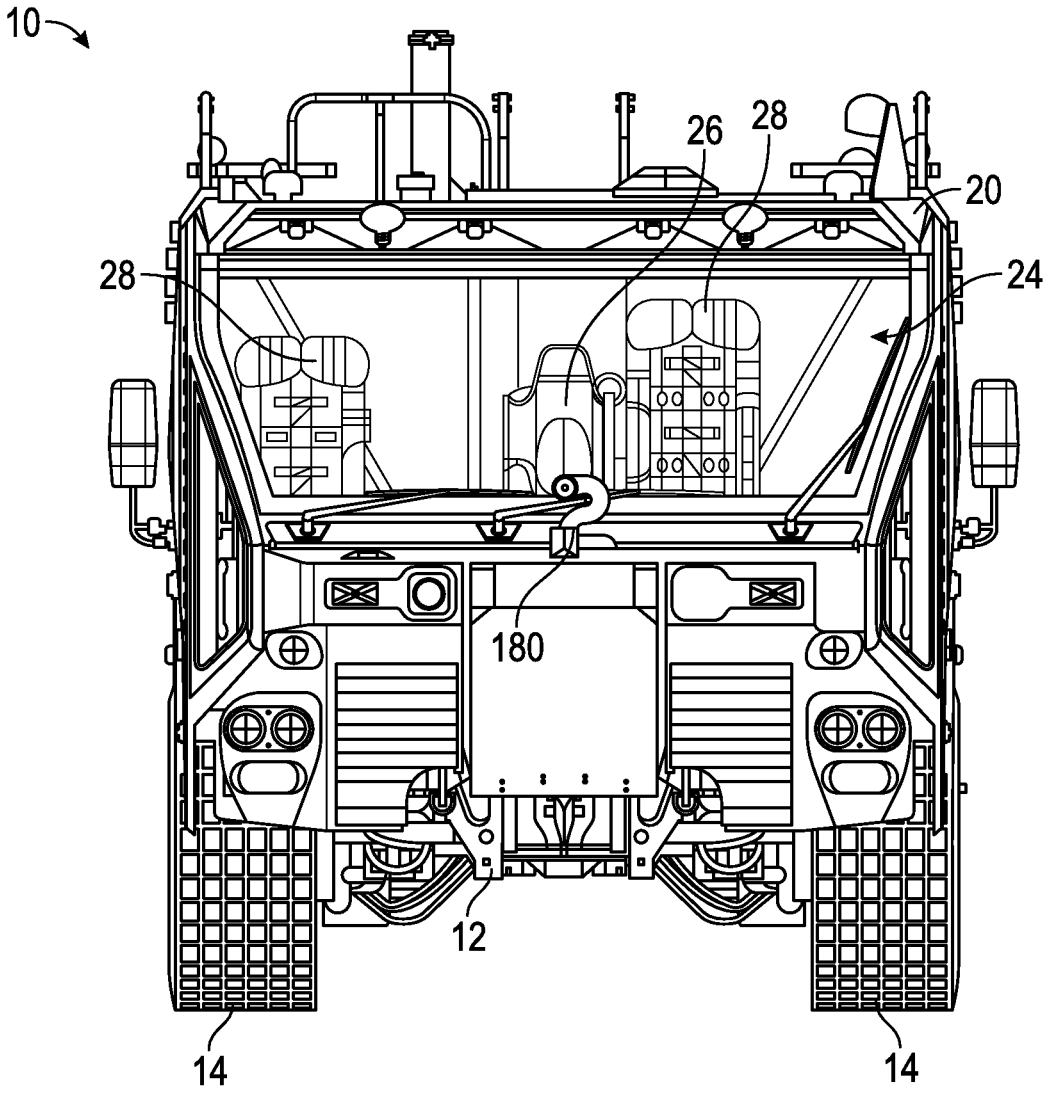
FIGS. 4A-4C are various front views of a fire fighting vehicle, according to an exemplary embodiment.
Figure 4B:
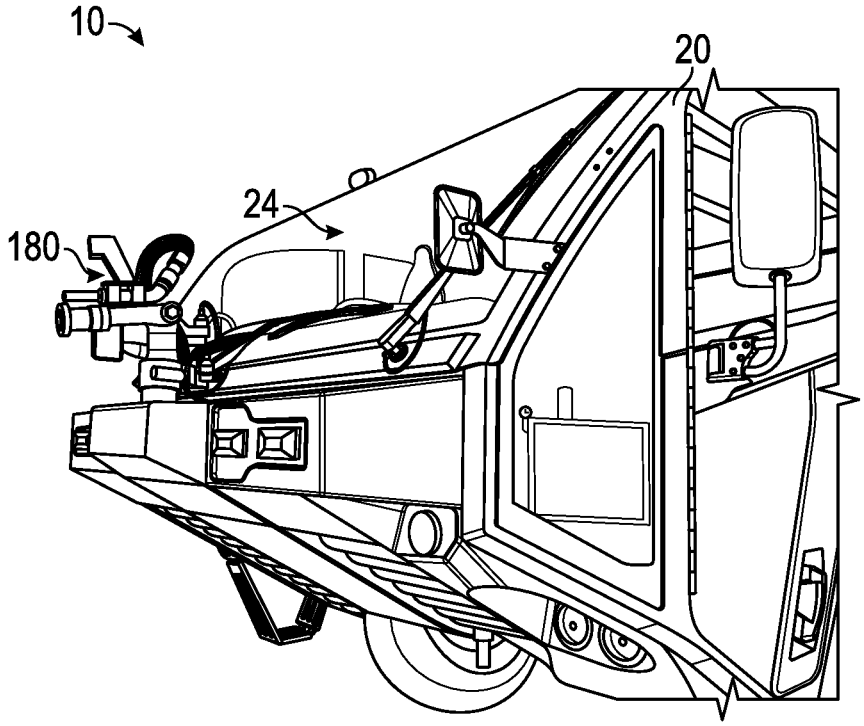
Figure 4C:
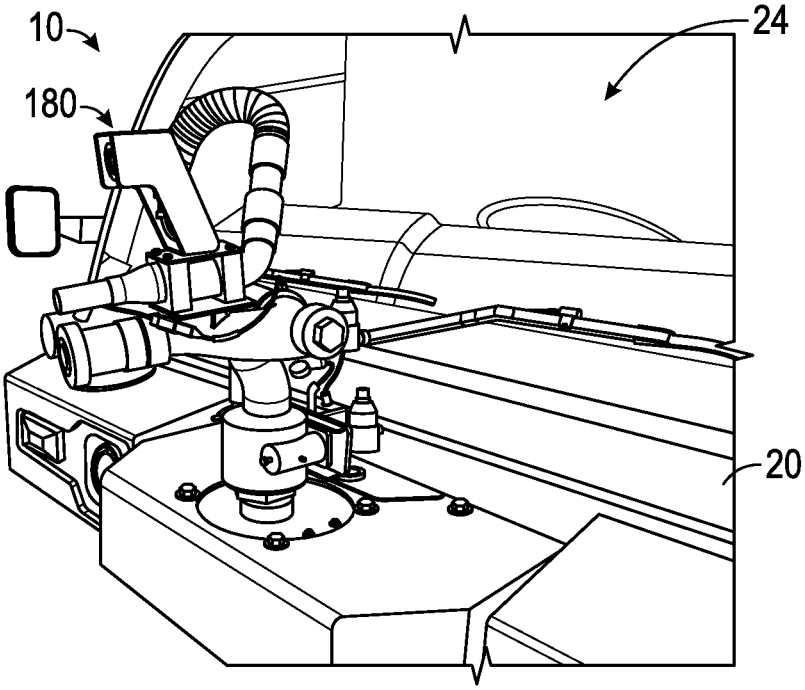
Figure 5:
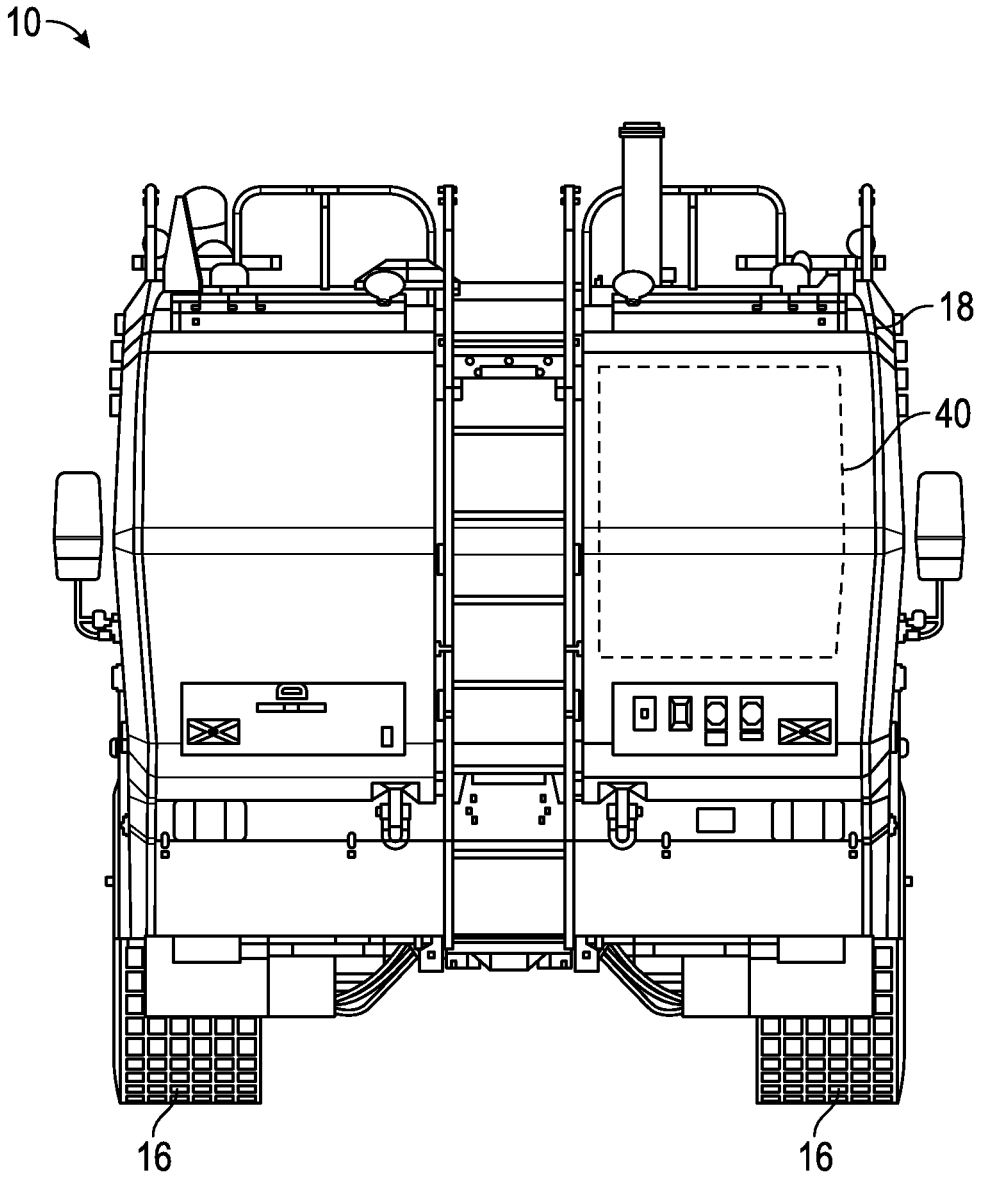
FIG. 5 is a rear plan view of a fire fighting vehicle, according to an exemplary embodiment.

As shown in FIGS. 1-3, the front cabin 20 is positioned forward of the rear section 18 (e.g., with respect to a forward direction of travel for the vehicle, etc.). According to an alternative embodiment, the front cabin 20 is positioned behind the rear section 18 (e.g., with respect to a forward direction of travel for the vehicle, etc.). According to an exemplary embodiment, the front cabin 20 includes a plurality of body panels coupled to a support (e.g., a structural frame assembly, etc.). The body panels may define a plurality of openings through which an operator accesses (e.g., for ingress, for egress, to retrieve components from within, etc.) an interior 24 of front cabin 20. As shown in FIGS. 1-2, front cabin 20 includes a pair of doors 22 positioned over the plurality of openings defined by the plurality of body panels. The doors 22 may provide access to the interior 24 of front cabin 20 for a driver (or passengers) of fire fighting vehicle 10.

Figure 6A:
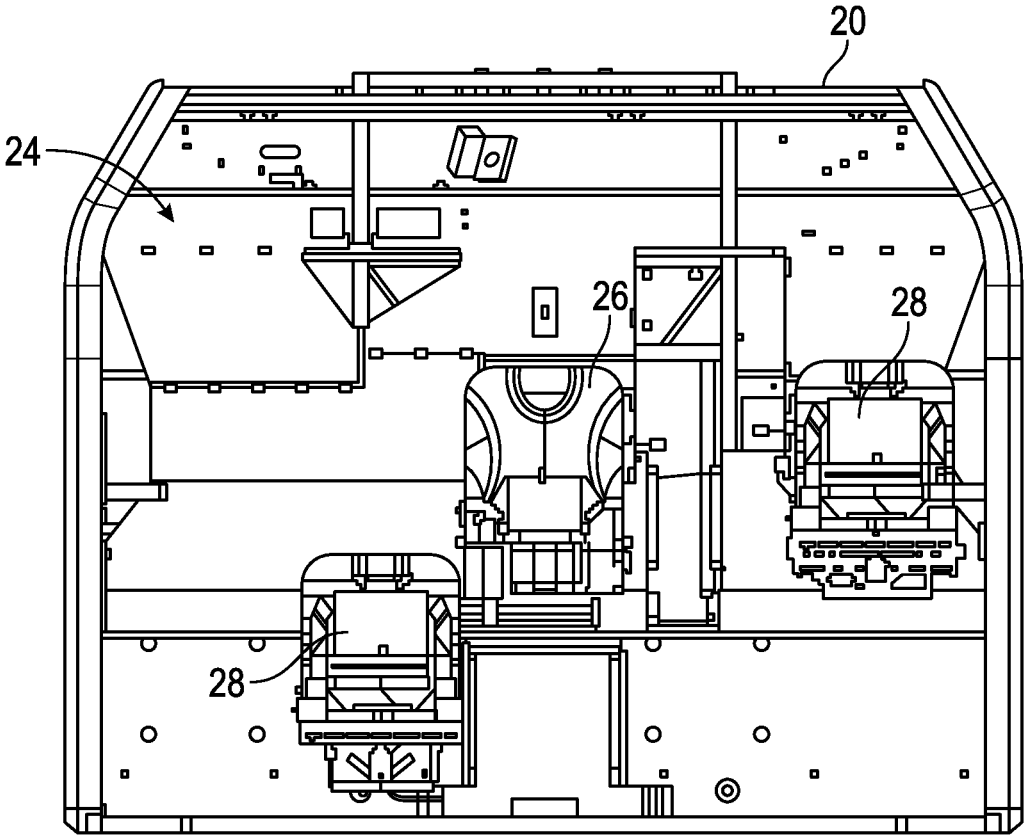
FIGS. 6A-6B are various detailed views of a cab interior of a fire fighting vehicle, according to an exemplary embodiment.
Figure 6B:
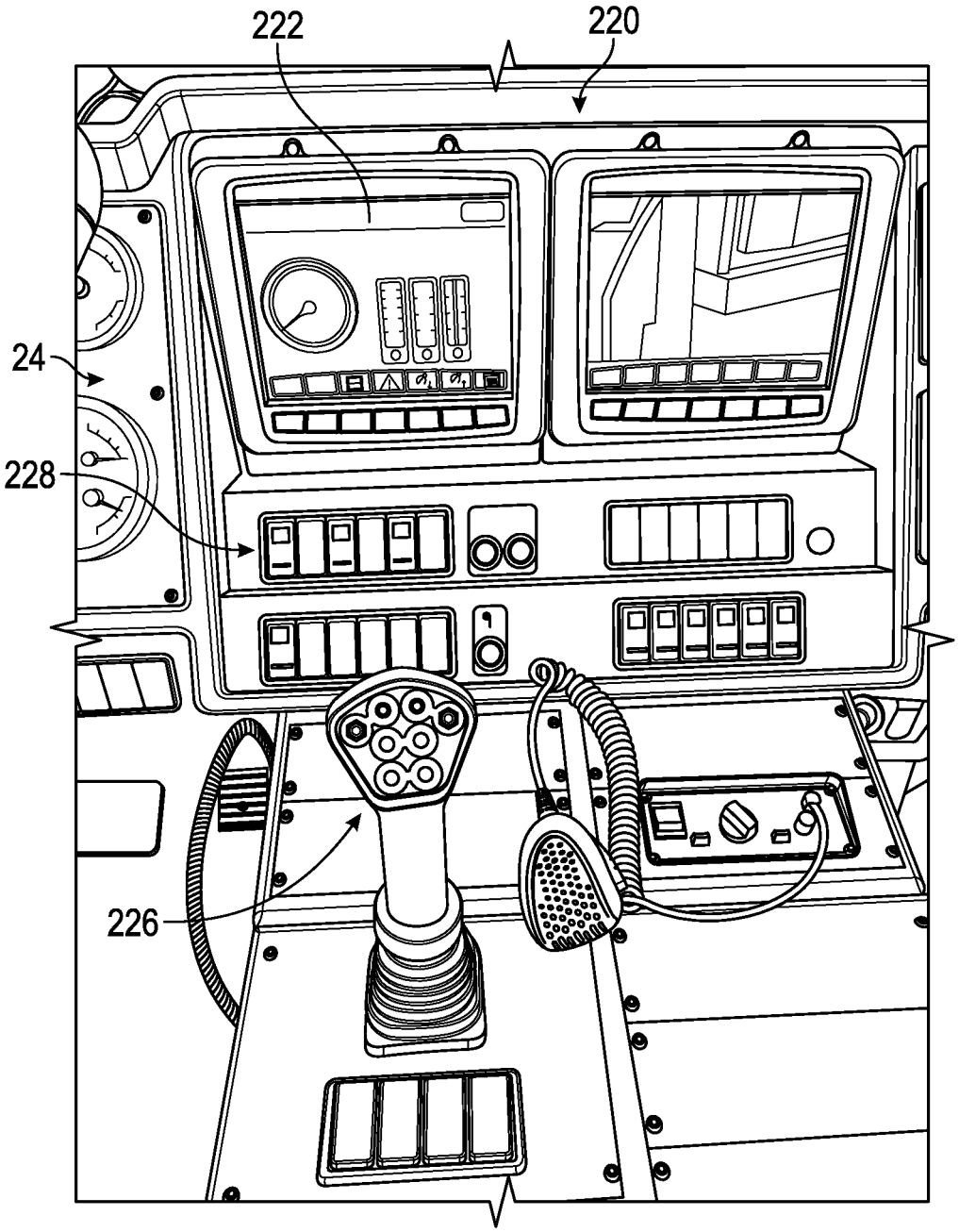

The front cabin 20 may include components arranged in various configurations. Such configurations may vary based on the particular application of the fire fighting vehicle 10, customer requirements, or still other factors. The front cabin 20 may be configured to contain or otherwise support at least one of a number of occupants, storage units, and equipment. As shown in FIGS. 1-2, 4A and 6A, the front cabin 20 is configured to provide seating for an operator (e.g., a driver, etc.) of the fire fighting vehicle 10 with a seat, shown as driver seat 26. In some embodiments, the front cabin 20 is configured to provide seating for one or more passengers of the fire fighting vehicle 10 with one or more seats, shown as passenger seats 28. The front cabin 20 may include one or more storage areas for providing compartmental storage for various articles (e.g., supplies, instrumentation, equipment, etc.). As shown in FIG. 6B, the interior 24 of the front cabin 20 may further include a user interface, shown as user interface 220. The user interface 220 may include a first display, shown as cabin display 222; a user input device, shown as turret joystick 226, and various controls, shown as controls 228 (e.g., buttons, switches, knobs, levers, etc.). In some embodiments, the user interface 220 within the interior 24 of the front cabin 20 further includes touchscreens, a steering wheel, an accelerator pedal, a brake pedal, among other components. The user interface 220 may provide the operator with control capabilities over the fire fighting vehicle 10 (e.g., direction of travel, speed, etc.), one or more components of UHP pumping system 100 (e.g., a turret, etc.), and/or still other components of the fire fighting vehicle 10 from within the front cabin 20.

Figure 7A:
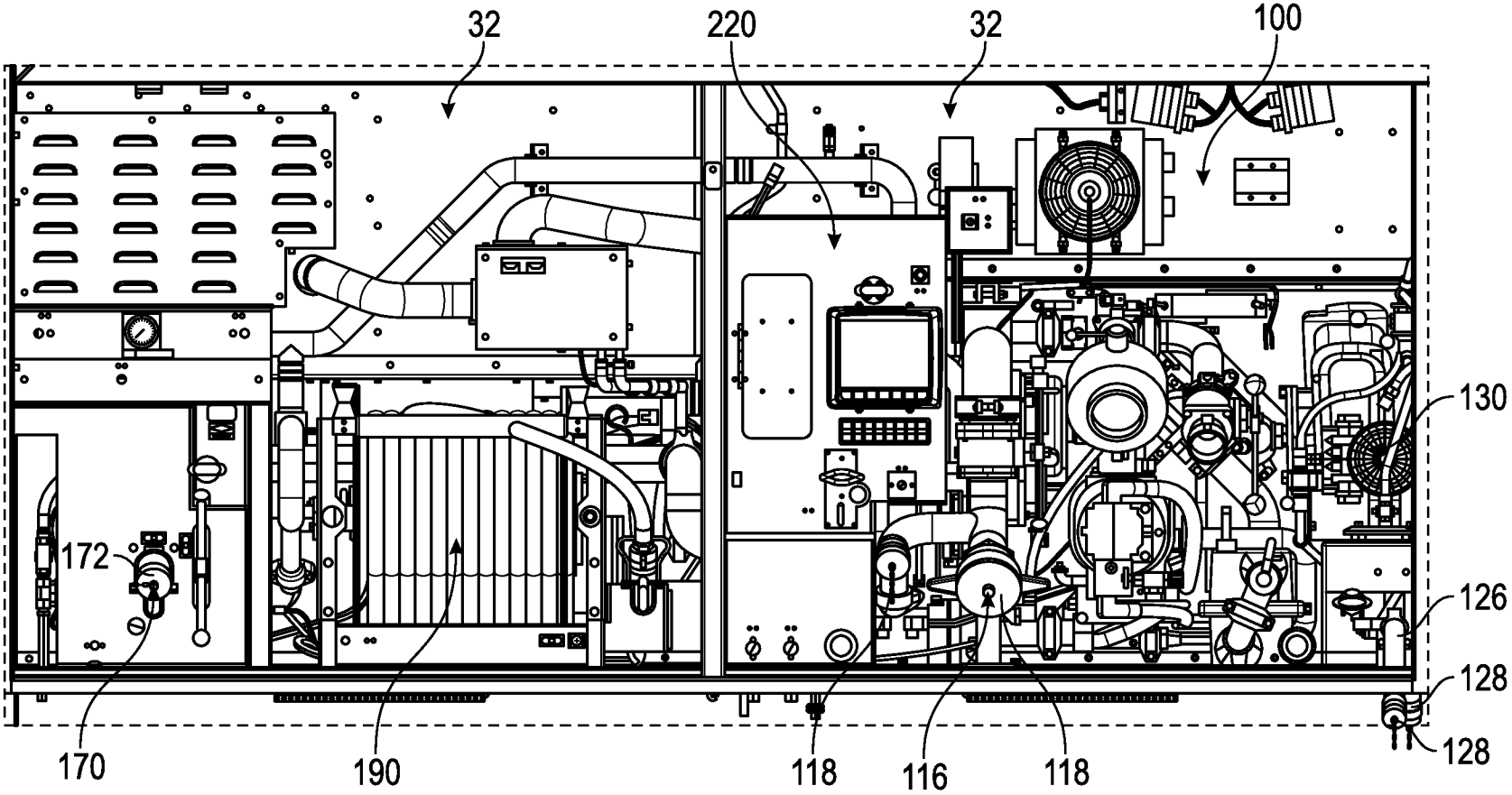
FIGS. 7A-7D are various detailed views of various components of a pumping system in a left side storage compartment of a fire fighting vehicle, according to an exemplary embodiment.
Figure 7B:
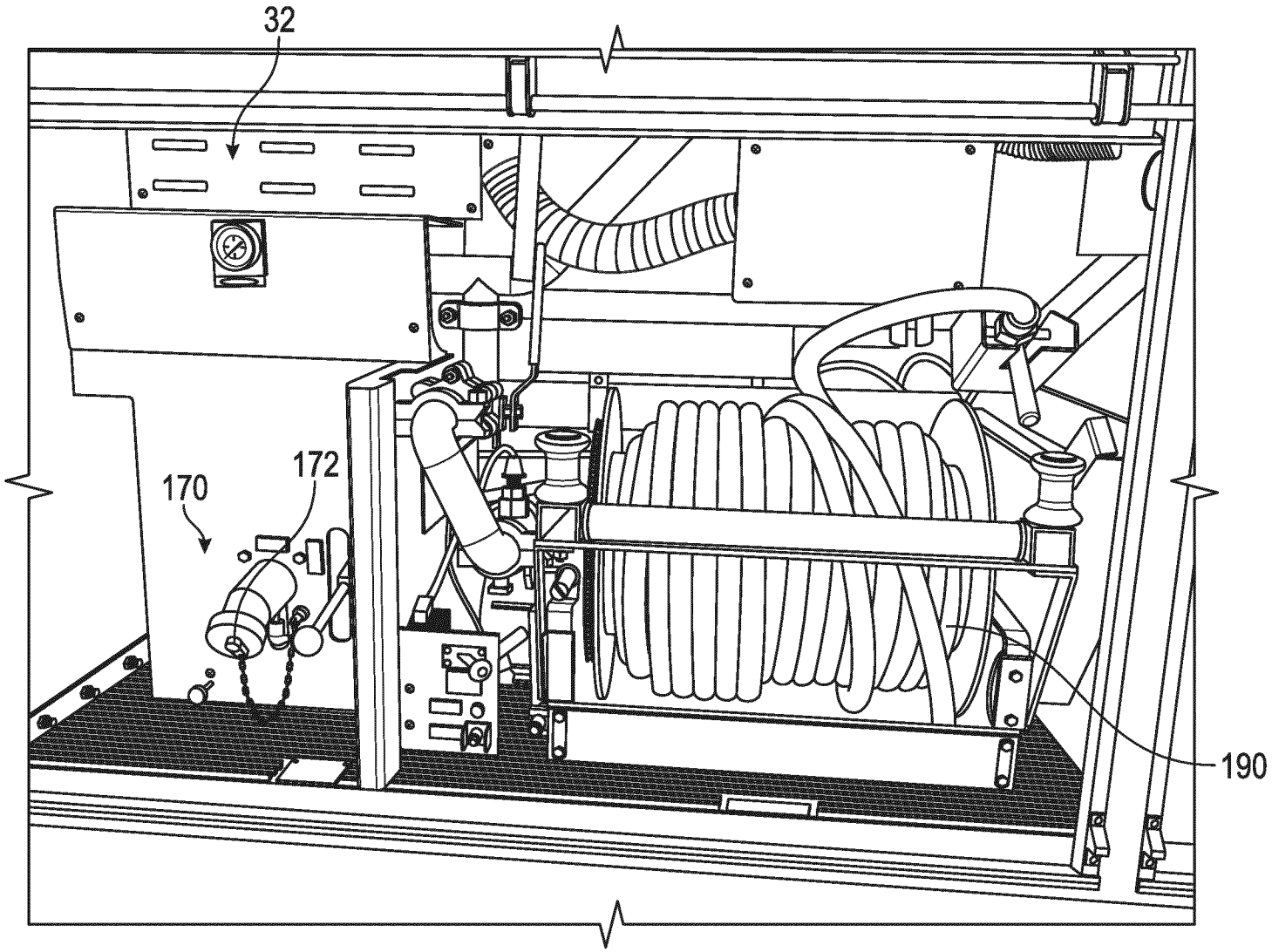
Figure 7C:
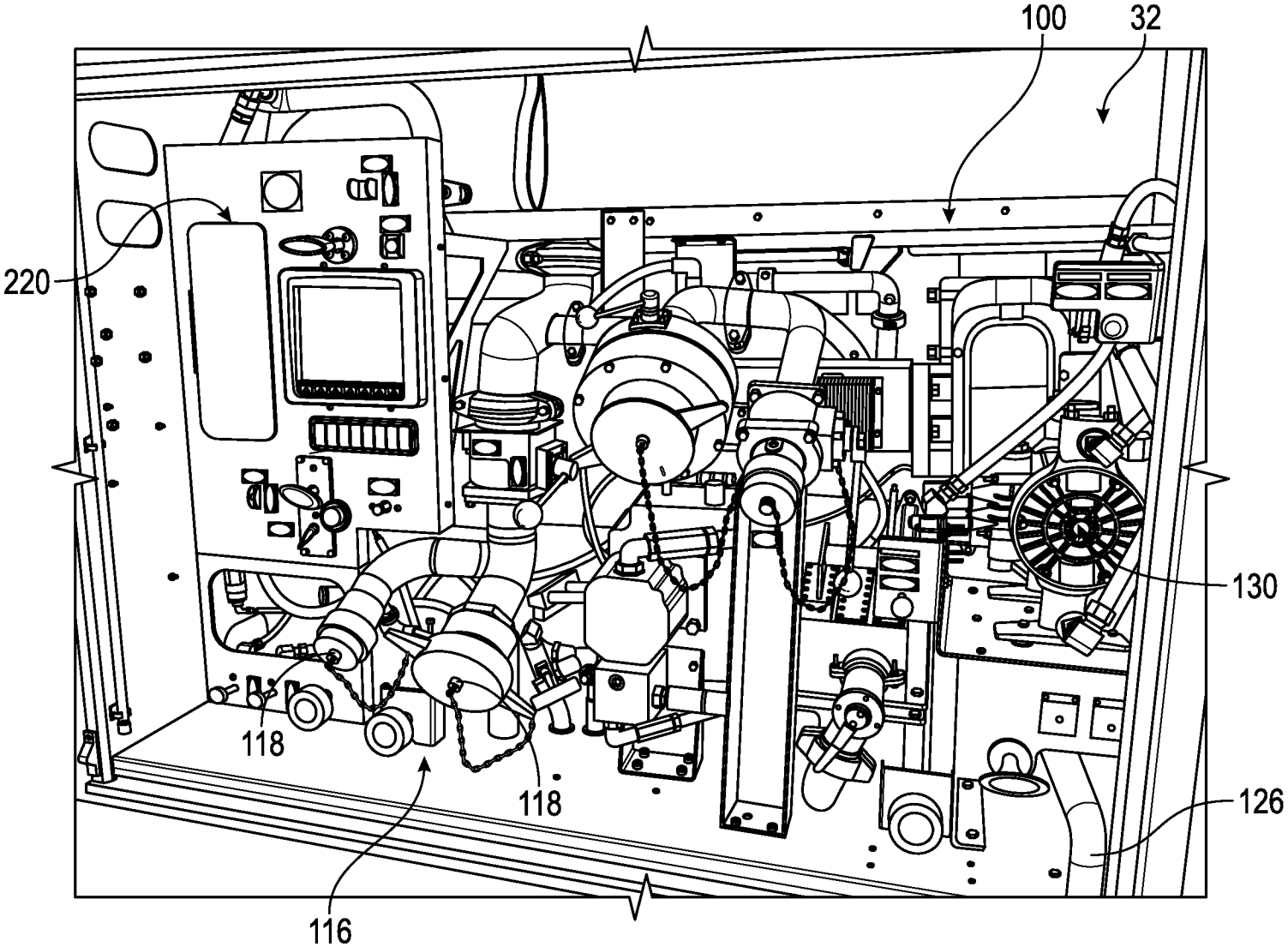
Figure 7D:
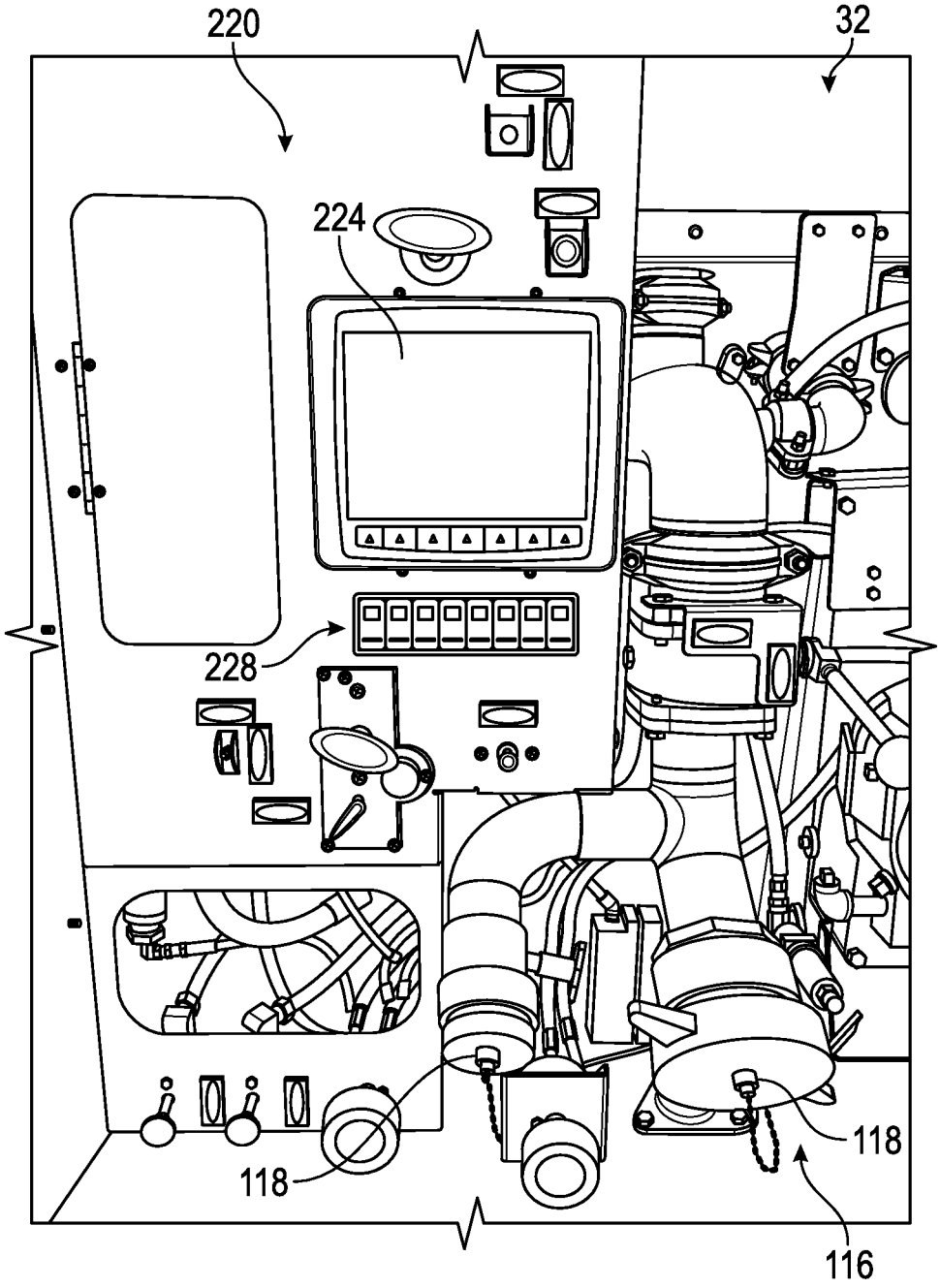

As shown in FIGS. 1 and 7A-7D, the rear section 18 includes a first plurality of compartments, shown as left compartments 32, with corresponding doors, shown as doors 30, disposed along a side (e.g., a left side, etc.) of the fire fighting vehicle 10. As shown in FIG. 7A-7D, the doors 30 may be selectively opened to gain access to various components of the fire fighting vehicle 10 within the left compartments 32, including one or more components of the UHP pumping system 100 and a second user interface 220. In other embodiments, the left compartments 32 define a cavity with various storage apparatuses (e.g., shelving, hooks, racks, etc.) for equipment (e.g., hoses, extinguishers, ladders, fire fighting gear, etc.). As shown in FIG. 7D, the second user interface 220 includes a second display, shown as side display 224, and various controls 228.

Figure 8:
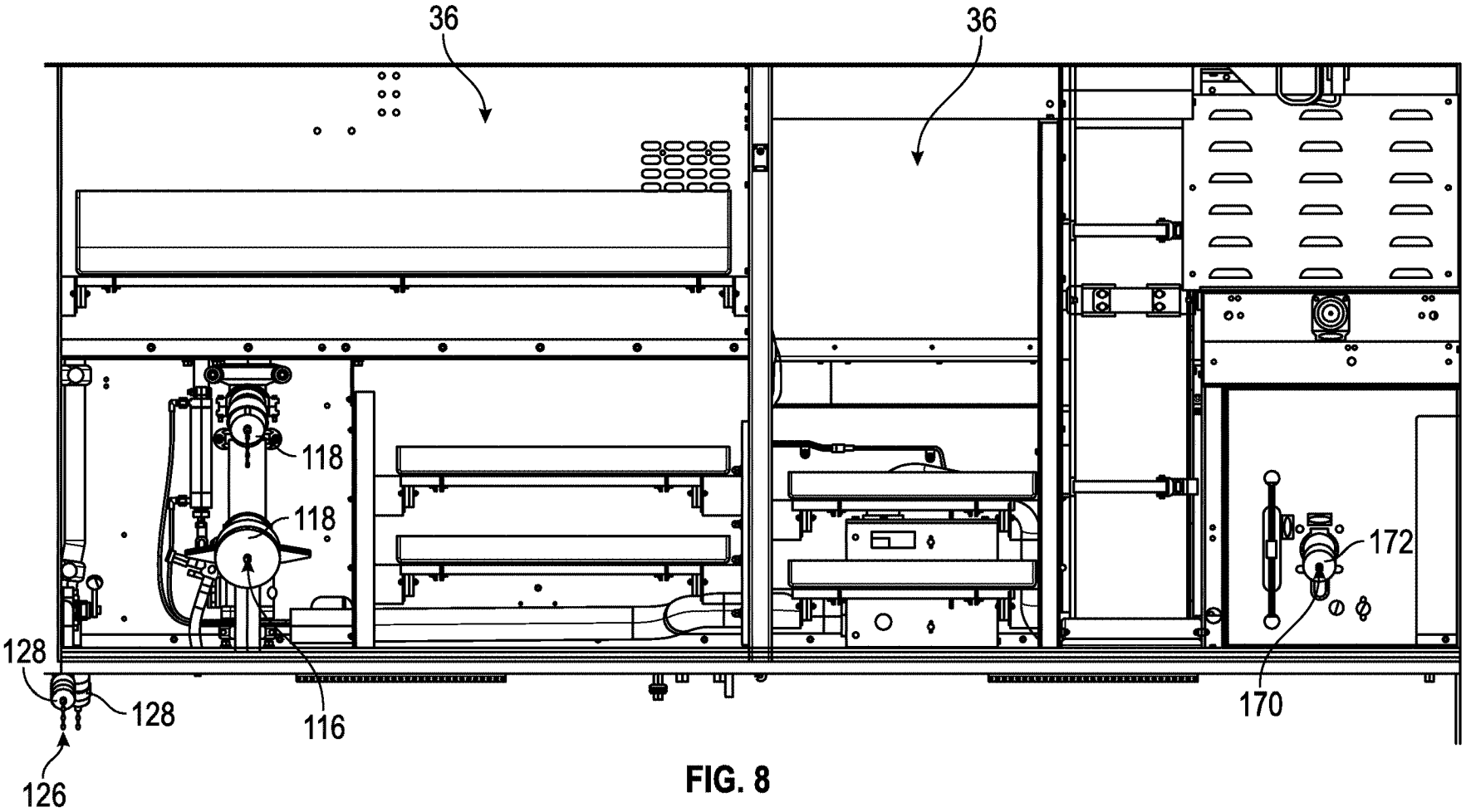
FIG. 8 is a detailed view of various components of a pumping system in a right side storage compartment of a fire fighting vehicle, according to an exemplary embodiment.

As shown in FIGS. 2 and 8, the rear section 18 includes a second plurality of compartments, shown as right compartments 36, with corresponding doors, shown as doors 34, disposed along a side (e.g., a right side, etc.) of the fire fighting vehicle 10. As shown in FIGS. 2 and 8, the doors 34 may be selectively opened to gain access to various components of the fire fighting vehicle 10 within the right compartments 36, including one or more components of the UHP pumping system 100, racks, shelving, and/or other storage apparatuses for storing fire fighting equipment. As shown in FIGS. 1-2, the rear section 18 includes additional compartments with corresponding doors, shown as doors 38. The doors 38 may be selectively opened to gain access to and/or store various equipment of the fire fighting vehicle 10 (e.g., hoses, fire fighting gear, etc.) within the additional compartments.

Figure 10:
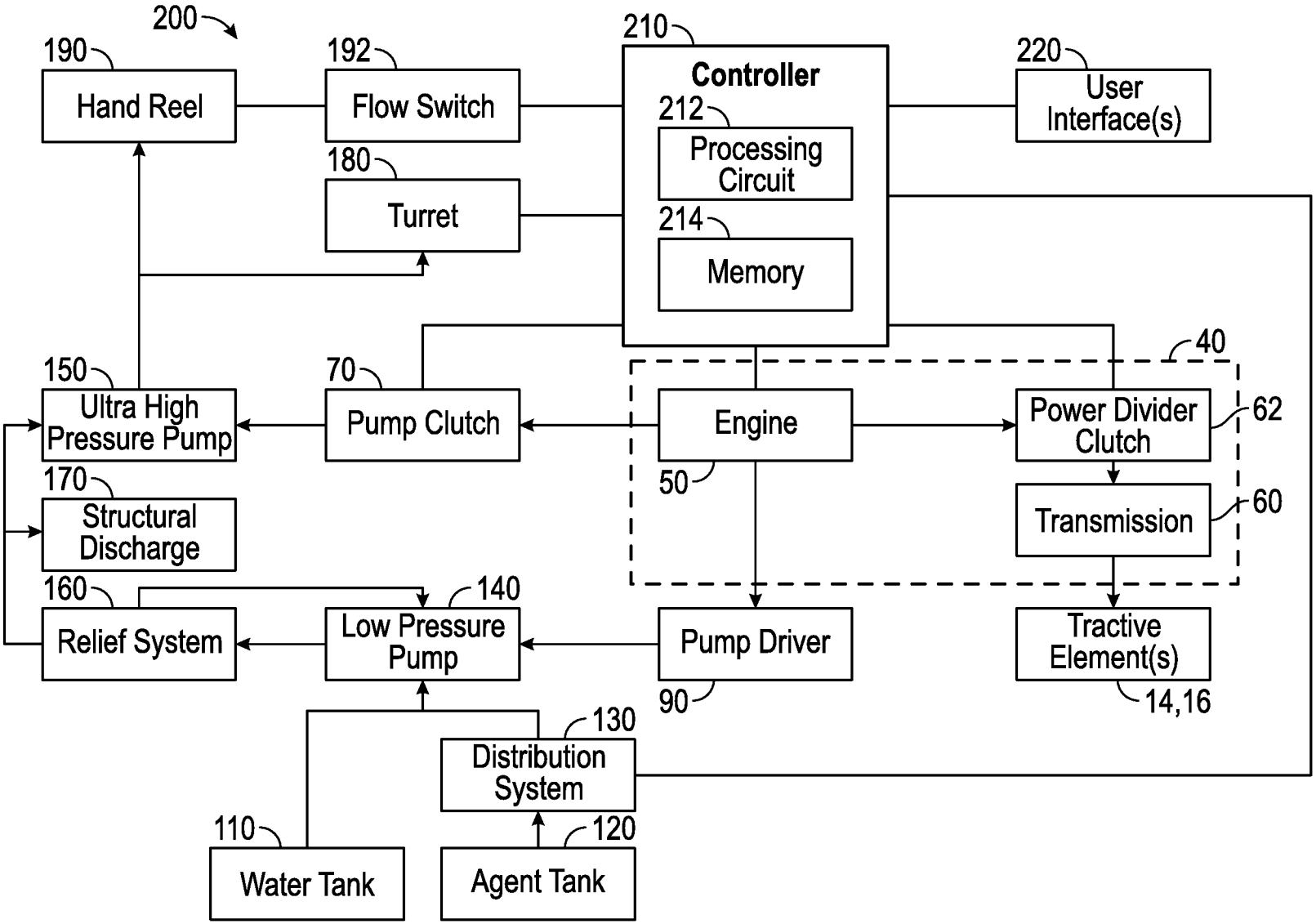
FIG. 10 is a block diagram of a controller used to operate and/or control various components of a fighting vehicle, according to an exemplary embodiment.

As shown in FIGS. 1-2,5, and 10, the fire fighting vehicle 10 includes a powertrain, shown as powertrain 40. As shown in FIG. 10, the powertrain 40 of the fire fighting vehicle 10 includes a driver, shown as engine 50; a transmission, shown as transmission 60; and a clutch, shown as power divider clutch 62. According to an exemplary embodiment, the power divider clutch 62 is configured to selectively mechanically couple the transmission 60 to the engine 50 (e.g., based on the mode of operation of the fire fighting vehicle 10, etc.). According to the exemplary embodiment shown in FIGS. 1-2, and 5, the fire fighting vehicle 10 is arranged as a rear engine vehicle. In alternative embodiments, the fire fighting vehicle 10 is one of a front engine vehicle and a mid-engine vehicle. In one embodiment, the engine 50 is coupled to the frame 12. According to an exemplary embodiment, the engine 50 receives fuel (e.g., gasoline, diesel, etc.) from a fuel tank and combusts the fuel to generate mechanical energy. The transmission 60 receives the mechanical energy and provides an output to a drive shaft. The rotating drive shaft is received by a differential, which conveys the rotational energy of the drive shaft to a final drive or tractive element, such as the front wheels 14 and/or the rear wheels 16. The front wheels 14 and/or the rear wheels 16 then propel or move the fire fighting vehicle 10. The powertrain 40 may be configured to drive the front wheels 14, the rear wheels 16, or a combination thereof (e.g., front-wheel-drive, rear-wheel-drive, all-wheel-drive, etc.).

According to an exemplary embodiment, the engine 50 is a compression-ignition internal combustion engine that utilizes diesel fuel. In alternative embodiments, the engine 50 is another type of driver (e.g., spark-ignition engine, fuel cell, electric motor, hybrid engine/motor, etc.) that is otherwise powered (e.g., with gasoline, compressed natural gas, hydrogen, electricity, etc.). According to an exemplary embodiment, the engine 50 is capable of providing a power output between 300 and 770 horsepower ("HP") and a torque output over 1950 foot-pounds ("ft-lbs"). In other embodiments, the engine 50 provides more or less power output and/or torque output. In one embodiment, the power output and/or the torque output of the engine 50 is modulated by a controller based on the mode of operation (e.g., structural mode, crash mode, driving mode, pump and roll mode, etc.) of the fire fighting vehicle 10 and/or the UHP pumping system 100.

As shown in FIGS. 1-3 and 9, the fire fighting vehicle 10 includes a first tank, shown as water tank 110, and a second tank, shown as agent tank 120. As shown in FIGS. 1-3, the water tank 110 and the agent tank 120 are disposed within the rear section 18 of the fire fighting vehicle 10. In other embodiments, the water tank 110 and/or the agent tank 120 are otherwise positioned (e.g., disposed along a rear, front, roof, side, etc. of the fire fighting vehicle 10, etc.). In an alternative embodiment, at least one of the water tank 110 and the agent tank 120 are omitted from the fire fighting vehicle 10. According to an exemplary embodiment, the water tank 110 and/or the agent tank 120 are corrosion and UV resistant polypropylene tanks.

According to an exemplary embodiment, the water tank 110 is configured to store a fluid, such as water or another liquid. In one embodiment, the water tank 110 is a 3,000 gallon capacity tank. In another embodiment, the water tank 110 is a 1,500 gallon capacity tank. In still another embodiment, the water tank 110 is a 4,500 gallon capacity tank. In other embodiments, the water tank 110 has another capacity. In some embodiments, multiple water tanks 110 are disposed within or along the rear section 18 of the fire fighting vehicle 10.

According to an exemplary embodiment, the agent tank 120 is configured to store an agent, such as a foam fire suppressant. According to an exemplary embodiment, the agent is an aqueous film forming foam ("AFFF"). AFFF is water-based and frequently includes hydrocarbon-based surfactant (e.g., sodium alkyl sulfate, etc.) and a fluorosurfactant (e.g., fluorotelomers, perfluorooctanoic acid, perfluorooctanesulfonic acid, etc.). AFFF has a low viscosity and spreads rapidly across the surface of hydrocarbon fuel fires. An aqueous film forms beneath the foam on the fuel surface that cools burning fuel and prevents evaporation of flammable vapors and re-ignition of fuel once it has been extinguished. The film also has a self-healing capability whereby holes in the film layer are rapidly resealed. In alternative embodiments, another agent is stored with the agent tank 120 (e.g., low-expansion foams, medium-expansion foams, high-expansion foams, alcohol-resistant foams, synthetic foams, protein-based foams, foams to be developed, etc.). In one embodiment, the agent tank 120 is a 420 gallon capacity tank. In another embodiment, the agent tank 120 is a 210 gallon capacity tank. In still another embodiment, the agent tank 120 is a 630 gallon capacity tank. In other embodiments, the agent tank 120 has another capacity. In some embodiments, multiple agent tanks 120 are disposed within or along the rear section 18 of the fire fighting vehicle 10. The capacity of the water tank 110 and/or the agent tank 120 may be specified by a customer. It should be understood that water tank 110 and the agent tank 120 configurations are highly customizable, and the scope of the present application is not limited to particular size or configuration of the water tank 110 and the agent tank 120. As shown in FIGS. 1-2, the fire fighting vehicle 10 includes one or more indicators, shown as fluid level indicators 102. The fluid level indicators 102 may be configured to provide an indication of the amount of water and/or agent within the water tanks 110 and/or the agent tank 120.

Figure 9:
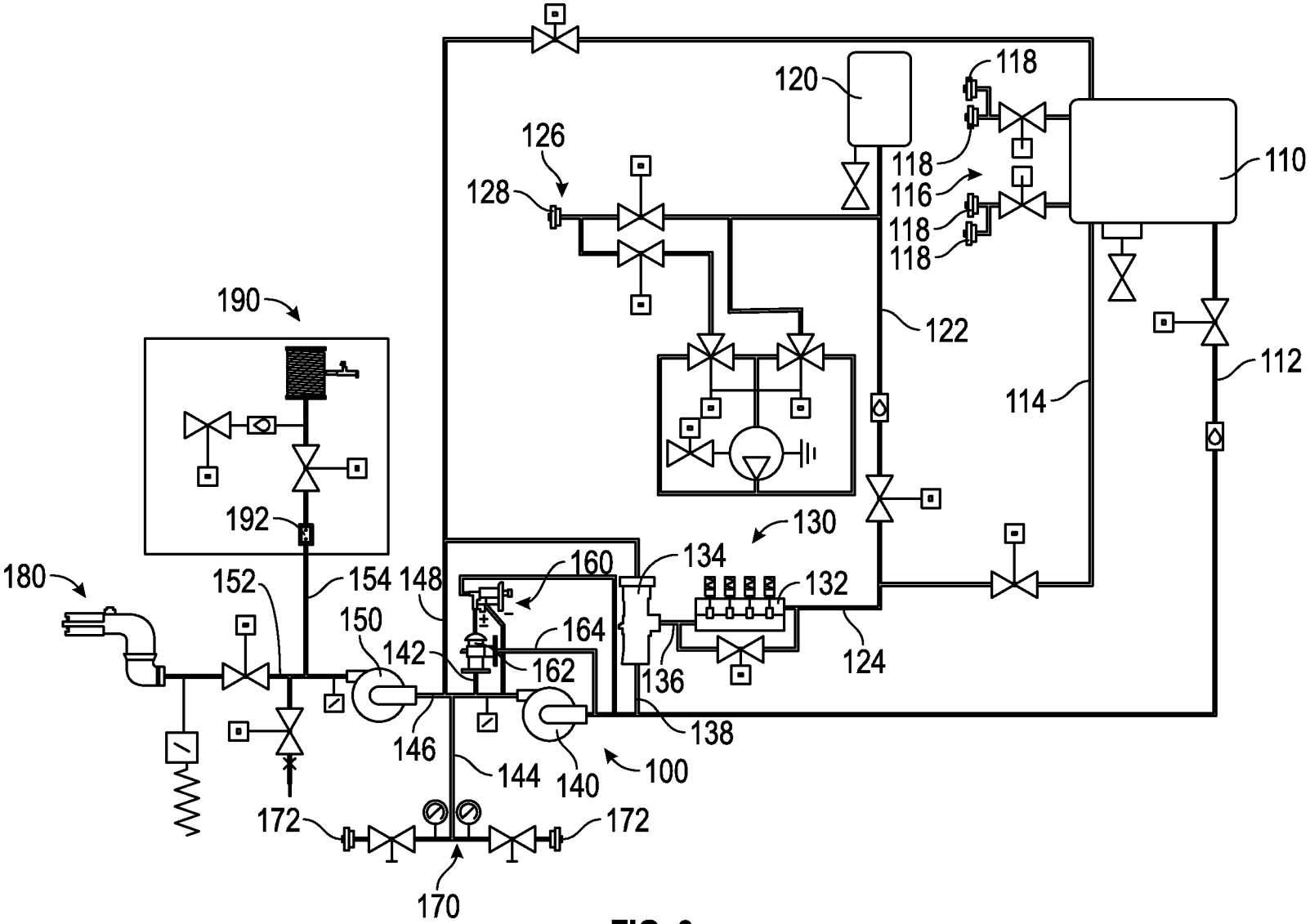
FIG. 9 is a schematic diagram of a pumping system for a fire fighting vehicle, according to an exemplary embodiment.

As shown is FIGS. 7A and 7C-9, the water tank 110 includes a plurality of conduits, shown as water fill lines 116, that extend therefrom to a plurality of inlets, shown as water inlets 118. As shown in FIG. 9, the water fill lines 116 fluidly couple the water inlets 118 to the water tank 110 such that the water tank 110 may be refilled with water (e.g., from a pumping station, from a fire hydrant, from a water truck, etc.) with the water inlets 118. As shown in FIGS. 7A and 7C-8, the water inlets 118 are positioned within the left compartments 32 and the right compartments 36. In other embodiments, the water inlets 118 are otherwise positioned (e.g., extend outward from the rear section 18, disposed along an exterior of the fire fighting vehicle 10, etc.). According to an exemplary embodiment, the water inlets 118 include a 2.5 inch diameter inlet and a 4.5 inch diameter inlet (e.g., to facilitate various connections between a water source, etc.). In other embodiments, one or more of the water inlets 118 are differently sized.

As shown is FIGS. 7A and 7C-9, the agent tank 120 includes a plurality of conduits, shown as agent fill lines 126, that extend therefrom to a plurality of inlets, shown as agent inlets 128. As shown in FIG. 9, the agent fill lines 126 fluidly couple the agent inlets 128 to the agent tank 120 such that the agent tank 120 may be refilled with agent (e.g., from a pumping station, etc.) with the agent inlets 128. As shown in FIGS. 7A and 8, the agent inlets 128 are positioned along a bottom edge of the rear section 18 on each lateral side of the fire fighting vehicle 10. In other embodiments, the agent inlets 128 are otherwise positioned (e.g., within the left compartments 32 and/or the right compartments 36, etc.). According to an exemplary embodiment, the agent inlets 128 include a 1.5 inch diameter inlet. In other embodiments, one or more of the agent inlets 128 are differently sized (e.g., a 2.5 inch diameter inlet, etc.).

As shown in FIGS. 9-10, the UHP pumping system 100 includes a first pump, shown as low pressure ("LP") pump 140, a second pump, shown as UHP pump 150, and a relief system, shown as relief system 160. According to an exemplary embodiment, the LP pump 140 is positioned upstream of the UHP pump 150 with the relief system 160 disposed therebetween and around the LP pump 140. The UHP pumping system 100 is arranged in a series configuration such that the LP pump 140 is configured to provide a pressurized fluid flow to the UHP pump 150 (e.g., in a crash mode, in a UHP mode, etc.), according to an exemplary embodiment.

As shown in FIGS. 9-10, an inlet (e.g., upstream side, etc.) of the LP pump 140 is fluidly coupled to the water tank 110, the agent tank 120 via a distribution system, shown as agent distribution system 130, and the relief system 160. An outlet (e.g., downstream side, etc.) of the LP pump 140 is fluidly coupled to the UHP pump 150, the relief system 160, and a first discharge, shown as structural discharge 170. As shown in FIGS. 9-10, an inlet (e.g., upstream side, etc.) of the UHP pump 150 is fluidly coupled to the LP pump 140, and an outlet (e.g., downstream side, etc.) of the UHP pump 150 is fluidly coupled to a second discharge, shown as turret 180, and a third discharge, shown as hose reel 190.

As shown in FIG. 9, the water tank 110 includes a first conduit, shown as water conduit 112, and a second conduit, shown as water conduit 114. The water conduit 112 extends from the water tank 110 to the inlet of the LP pump 140 (e.g., directly fluidly coupling to the water tank 110 to the LP pump 140, etc.). Thus, water from the water tank 110 may be directly pumped through the LP pump 140 (e.g., to the UHP pump 150, the structural discharge 170, the relief system 160, etc.). As shown in FIG. 9, the agent tank 120 includes a conduit, shown as agent conduit 122. The agent conduit 122 and the water conduit 114 may intersect with an inlet of the agent distribution system 130, shown as inlet conduit 124. Thus, at least one of agent from the agent tank 120 and water from the water tank 110 may be provided to the agent distribution system 130 via the inlet conduit 124.

As shown in FIG. 9, the agent distribution system 130 includes a manifold, shown as agent manifold 132, fluidly coupled to an eductor, shown as agent eductor 134, with a conduit, shown as intermediate conduit 136. According to an exemplary embodiment, the agent manifold 132 is configured to modulate an amount of agent or water-agent solution flowing through the agent distribution system 130 to provide a proper water-agent solution, and the agent eductor 134 is configured to inject the agent or the water-agent solution into the water flowing to the inlet of the LP pump 140 from the water conduit 112 through an outlet, shown as outlet conduit 138, of the agent distribution system 130. According to an exemplary embodiment, the agent distribution system 130 is an around-the-pump agent system that provides agent to the LP pump 140. Since the LP pump 140 and the UHP pump 150 are arranged in series, only a single agent distribution system 130 is needed (i.e., the agent distribution system 130 provides the agent to the LP pump 140, which is in turn provided to at least one of the UHP pump 150 and the structural discharge 170).

As shown in FIG. 9, the outlet of the LP pump 140 is fluidly coupled to the relief system 160 via a first outlet conduit, shown as relief conduit 142, the structural discharge 170 via a second outlet conduit, shown as structural conduit 144, and the UHP pump via a third conduit, shown as pump conduit 146. In some embodiments, the outlet of the LP pump 140 is fluidly coupled to the water tank 110 via a fourth outlet conduit, shown as water conduit 148. As shown in FIG. 9, the relief system 160 includes a valve, shown as relief valve 162. The relief valve 162 is configured to regulate the pressure of the fluid flow (e.g., water, agent, water-agent solution, etc.) from the outlet of the LP pump 140 to a target pressure for all flow rates. According to an exemplary embodiment, the relief valve 162 is configured to regulate the fluid flow to a target pressure of 170 pounds-per-square-inch ("psi") and/or a flow rate up to 320 gallons per minute ("gpm"). In other embodiments, the target pressure is another pressure (e.g., 200 psi, 150 psi, etc.) and the flow rate is another flow rate (e.g., 300 gpm, 20 gpm, etc.). The relief valve 162 is positioned to relieve pressure of the fluid exiting the LP pump 140 by intaking a portion of the fluid exiting the LP pump 140 through the relief conduit 142, thereby reducing the pressure of the outlet fluid flow. The relief valve 162 may then return the portion of fluid received from the LP pump 140 upstream of the LP pump 140 via a conduit, shown as return conduit 164. In an alternative embodiment, the fluid from the relief valve 162 is at least one of returned to the water tank 110, the agent tank 120, and expelled from the system (e.g., to an external environment, etc.).

As shown in FIGS. 7A-7B and 8-9, the structural discharge 170 includes a plurality of outlets, shown as low pressure outlets 172. As shown in FIGS. 7A-7B and 8, the low pressure outlets 172 are positioned within the left compartments 32 and the right compartments 36. In other embodiments, the low pressure outlets 172 are otherwise positioned (e.g., extend outward from the rear section 18, disposed along an exterior of the fire fighting vehicle 10, etc.). According to an exemplary embodiment, the low pressure outlets 172 include a 2.5 inch diameter outlet. In other embodiments, one or more of the low pressure outlets 172 are differently sized. According to an exemplary embodiment, the low pressure outlets 172 are configured to engage a hose during a structural mode of operation (e.g., low pressure mode, etc.) of the UHP pumping system 100 such that the fluid (e.g., water and/or agent, etc.) pumped via the LP pump 140 to the structural discharge 170 via the structural conduit 144 may be applied to a fire at a low pressure (e.g., 170 psi, etc.). According to an exemplary embodiment, the relief valve 162 is configured to regulate the fluid flow during the structural mode in a manner that accounts for the length of hose (e.g., 10 feet, 500 feet, etc.) coupled to the low pressure outlets 172 such that the fluid is provided at the target pressure at an output of the hose (i.e., accounts for the flow losses in the hose).

As shown in FIG. 9, the inlet of the UHP pump 150 is fluidly coupled to the LP pump 140 via the pump conduit 146. Thus, the UHP pump 150 receives the fluid from the LP pump 140 at the target pressure (e.g., 170 psi, provided by the relief system 160, consistent inlet conditions, etc.). According to an exemplary embodiment, providing pre-pressurized fluid to the UHP pump 150 reduces (e.g., eliminates, etc.) priming issues of the UHP pump 150, increases the output pressure capabilities of the UHP pump 150, reduces the power output and/or torque output needed from the engine 50 to drive the UHP pump 150 to reach higher pressures, reduces (e.g., eliminates, etc.) cavitation at the inlet of the UHP pump 150, and/or decreases the overall size of the UHP pump 150 (e.g., increasing available space and serviceability of the UHP pumping system 100, etc.). As shown in FIG. 9, the outlet of the UHP pump 150 is fluidly coupled to the turret 180 via a first outlet conduit, shown as turret conduit 152, and the hose reel 190 via a second outlet conduit, shown as hose reel conduit 154. According to an exemplary embodiment, the UHP pump 150 is configured to increase the pressure of the fluid provided by the LP pump 140 to a substantially higher pressure (e.g., between 1000 psi and 1500 psi, an ultra high pressure, etc.). According to an exemplary embodiment, the substantially higher pressure causes the turret 180 and/or the hose reel 190 to create smaller water and/or agent droplets, thereby increasing the surface area of the fluid being expelled by the UHP pumping system 100 relative to traditional systems. Increased surface area of the fluid may thereby increase the rate at which heat transfer occurs such that the UHP pumping system 100 has a higher fire fighting capability (e.g., relative to traditional systems, etc.).

As shown in FIGS. 1-4C, the turret 180 is positioned on a front bumper of the fire fighting vehicle 10. In other embodiments, the turret 180 is otherwise positioned (e.g., attached to a boom, on the roof, on the rear section 18, etc.). In some embodiments, the fire fighting vehicle 10 includes a plurality of turrets 180 (e.g., a bumper turret and a roof turret, etc.). According to an exemplary embodiment, the turret 180 is controlled via a user interface (e.g., the user interface 220, etc.) located within the interior of the front cabin 20. In some embodiments, the turret 180 can be manually operated (e.g., during a fault condition, etc.). According to an exemplary embodiment, the UHP pump 150 is configured to provide the fluid to the turret 180 at a target pressure of 1250 psi and a target flow rate of at least 300 gpm. In some embodiments, the UHP pump 150 provides the fluid to the turret 180 at a different pressure and/or flow rate (e.g., 315 gpm, 310 gpm, 1300 psi, based on the use of the hose reel 190, etc.). As shown in FIGS. 7A-7B, the hose reel 190 is positioned within one of the left compartments 32. In other embodiments, the hose reel 190 is otherwise positioned (e.g., within the right compartments 36, on the roof of the fire fighting vehicle 10, etc.). In some embodiments, the fire fighting vehicle 10 includes a plurality of hose reels 190 (e.g., one on each lateral side of the fire fighting vehicle 10, etc.). According to an exemplary embodiment, the UHP pump 150 is configured to provide the fluid to the hose reel 190 at a target pressure of 1100 psi and a target flow rate of 20 gpm. In some embodiments, the UHP pump 150 provides the fluid to the hose reel 190 at a different pressure and/or flow rate (e.g., 25 gpm, 1000 psi, etc.).

According to an exemplary embodiment, the UHP pumping system 100 is selectively reconfigurable between a first mode of operation (e.g., a crash mode, a UHP mode, a pump and roll mode, etc.) and a second mode of operation (e.g., a structural mode, a LP mode, etc.). In the first mode of operation, the LP pump 140 is configured to provide the fluid to the UHP pump 150 at a target pressure (e.g., 170 psi, etc.) and/or flow rate through the pump conduit 146. The UHP pump 150 is configured to then provide the fluid to at least one of the turret 180 and the hose reel 190 at a high target pressure. In the first mode of operation, the turret 180, the hose reel 190, or both may be used to project water, agent, or a water-agent solution onto a fire (e.g., at a high pressure, etc.). According to an exemplary embodiment, the fire fighting vehicle 10 is drivable during the first mode of operation (e.g., in a pump and roll mode, etc.). In the second mode of operation, the LP pump 140 is configured to provide the fluid to the structural discharge 170 at a target pressure (e.g., 170 psi, etc.) through the structural conduit 144 such that water, agent, or a water-agent solution may be projected onto a fire with a hose coupled to the low pressure outlets 172. According to an exemplary embodiment, the UHP pump 150 is disengaged (e.g., off, decoupled from the engine 50, does not pump fluid, etc.) during the second mode of operation (e.g., increasing efficiency of the UHP pumping system 100 during the structural mode, etc.). In some embodiments, the fire fighting vehicle 10 is in a park mode during the second mode of operation (i.e., the fire fighting vehicle 10 functions as a municipal fire truck). In order to provide the target pressures and flows rates to the structural discharge 170, the turret 180, and/or the hose reel 190, various components of the fire fighting vehicle 10 may need to be monitored and/or controlled. As shown in FIGS. 9-10, the hose reel 190 includes a sensor, shown as flow switch 192. According to an exemplary embodiment, the flow switch 192 is configured to monitor a state of the hose reel 190 (e.g., closed, open, discharging fluid, etc.).

As shown in FIG. 10, the LP pump 140 is coupled to a driver, shown as pump driver 90. In one embodiment, the pump driver 90 is hydraulically operated (e.g., with a hydrostatic drive system, etc.). In other embodiments, the pump driver 90 is otherwise operated (e.g., electrically, etc.). According to an exemplary embodiment, the pump driver 90 is coupled to a power take off ("PTO") of the engine 50. The pump driver 90 is configured to operate (i.e., drive) the LP pump 140. According to an exemplary embodiment, the LP pump 140 is configured to provide a pressurized fluid flow at a pressure greater than the target pressure when the pump driver 90 operates the LP pump 140 at the lowest operating speed of the LP pump 140 (i.e., the outlet pressure of the fluid from the LP pump 140 is greater than the target pressure). Thus, the relief system 160 is always relieving pressure from the fluid flow entering the UHP pump 150 and/or the structural discharge 170 to provide the target pressure, according to an exemplary embodiment. In other embodiments, the LP pump 140 is capable of providing pressures less than the target pressure. Thus, the pump driver 90 may control the speed of the LP pump 140 to achieve the target pressure.

As shown in FIG. 10, the UHP pump 150 is selectively coupled to the engine 50 with a second clutch, shown as pump clutch 70. In one embodiment, the UHP pump 150 is driven by the engine 50, and the speed of the UHP pump 150 directly corresponds with the engine speed. The pump clutch 70 is configured to be selectively engaged based on the mode of operation of the UHP pumping system 100. According to an exemplary embodiment, the pump clutch 70 is engaged during the first mode of operation and disengaged during the second mode of operation. Therefore, the UHP pumping system 100 may operate with an increased efficiency by decoupling the UHP pump 150 from the engine 50 during the second mode of operation.

According to the exemplary embodiment shown in FIG. 10, a control system 200 for a vehicle (e.g., the fire fighting vehicle 10, etc.) includes a controller 210. In one embodiment, the controller 210 is configured to selectively engage, selectively disengage, control, or otherwise communicate with components of the vehicle according to various modes of operation. As shown in FIG. 10, the controller 210 is coupled to the engine 50, the power divider clutch 62, the pump clutch 70, the agent distribution system 130, the turret 180, the flow switch 192, and the user interface 220. The controller 210 may be configured to selectively control the speed of the engine 50 (e.g., interface with a throttle of, etc.) such that an output of engine 50 rotates at a target speed based on at least one of the mode of operation the UHP pumping system 100 (e.g., crash mode, structural mode, etc.), which of the discharges are open (e.g., the structural discharge 170, the turret 180, the hose reel 190, etc.), and a mode of the fire fighting vehicle 10 (e.g., pump and roll mode, structural mode, etc.). By way of example, the controller 210 may send and receive signals with the engine 50, the power divider clutch 62, the pump clutch 70, the agent distribution system 130, the turret 180, the flow switch 192, and/or the user interface 220. According to an exemplary embodiment, the controller 210 provides a seamless operator experience (e.g., the operator does not have to manually actuate the LP pump 140 or the UHP pump 150, etc.). By way of example, the controller 210 may automatically engage the first mode of operation (e.g., a crash mode, a UHP mode, a pump and roll mode, etc.) when a corresponding outlet (e.g., the turret 180, the hose reel 190, etc.) is opened and/or a high pressure discharge signal is provided (e.g., a turret request from an operator, etc.).

The controller 210 may be implemented as a general-purpose processor, an application specific integrated circuit (ASIC), one or more field programmable gate arrays (FPGAs), a digital-signal-processor (DSP), circuits containing one or more processing components, circuitry for supporting a microprocessor, a group of processing components, or other suitable electronic processing components. According to the exemplary embodiment shown in FIG. 10, the controller 210 includes a processing circuit 212 and a memory 214. Processing circuit 212 may include an ASIC, one or more FPGAs, a DSP, circuits containing one or more processing components, circuitry for supporting a microprocessor, a group of processing components, or other suitable electronic processing components. In some embodiments, processing circuit 212 is configured to execute computer code stored in memory 214 to facilitate the activities described herein. Memory 214 may be any volatile or non-volatile computer-readable storage medium capable of storing data or computer code relating to the activities described herein. According to an exemplary embodiment, memory 214 includes computer code modules (e.g., executable code, object code, source code, script code, machine code, etc.) configured for execution by processing circuit 212. Memory 214 includes various actuation profiles corresponding to modes of operation (e.g., for the UHP pumping system 100, for the fire fighting vehicle 10, etc.), according to an exemplary embodiment. In some embodiments, controller 210 may represent a collection of processing devices (e.g., servers, data centers, etc.). In such cases, processing circuit 212 represents the collective processors of the devices, and memory 214 represents the collective storage devices of the devices.

In one embodiment, the user interface 220 includes a display and an operator input. The display may be configured to display a graphical user interface, an image, an icon, or still other information. In one embodiment, the display includes a graphical user interface configured to provide general information about the vehicle (e.g., vehicle speed, fuel level, warning lights, agent levels, water levels, etc.). The graphical user interface may also be configured to display a current mode of operation, various potential modes of operation, or still other information relating to the fire fighting vehicle 10 and/or the UHP pumping system 100. By way of example, the graphical user interface may be configured to provide specific information regarding the operation of UHP pumping system 100 (e.g., whether the pump clutch 70, the turret 180, the hose reel 190 are engaged or disengaged, whether the first mode of operation or the second mode of operation is engaged, pressure and flow data, etc.).

The operator input may be used by an operator to provide commands to at least one of the engine 50, the power divider clutch 62, the pump clutch 70, the agent distribution system 130, and the turret 180. The operator input may include one or more buttons, knobs, touchscreens, switches, levers, joysticks, pedals, or handles. In one embodiment, an operator may press a button and/or engage a discharge to change the mode of operation for at least one of the UHP pumping system 100 and the fire fighting vehicle 10. The operator may be able to manually control some or all aspects of the operation of the UHP pumping system 100 and the fire fighting vehicle 10 using the display and the operator input. It should be understood that any type of display or input controls may be implemented with the systems and methods described herein.

According to an exemplary embodiment, the controller 210 is configured to engage the pump clutch 70 during the first mode of operation (i.e., coupling the UHP pump 150 to the engine 50) and disengage the pump clutch 70 during the second mode of operation (i.e., decoupling the UHP pump 150 from the engine 50). The first mode of operation may be initiated in response to at least one of a user input to the user interface 220 to activate the first mode of operation, a user input to the user interface 220 to discharge fluid from the turret 180 (e.g., by pressing a trigger, etc.), and manually discharging fluid from the hose reel 190. The second mode of operation may be initiated in response to a user input to the user interface 220 to activate the second mode of operation. In some embodiments, the controller 210 prevents the second mode of operation from being initiated unless the transmission 60 is in a park configuration (i.e., the fire fighting vehicle 10 is stopped and parked).

According to an exemplary embodiment, the controller 210 is configured to regulate a speed of the engine 50 during the first mode of operation (e.g., crash mode, UHP mode, pump and roll mode, etc.). In embodiments where the engine speed is related to (e.g., directly related to, etc.) a pump speed of the UHP pump 150 (i.e., since the UHP pump 150 is coupled to the engine 50 with the pump clutch 70), the controller 210 may change the engine speed to regulate the outlet pressure and/or flow rate of the fluid (e.g., water, agent, water-agent solution, etc.) provided to the turret 180 and/or the hose reel 190 from the UHP pump 150 to satisfy various regulatory requirements (e.g., National Fire Protection Association ("NFPA") requirements, since the flow from the UHP pump 150 is unregulated by the relief system 160, etc.).

According to an exemplary embodiment, the controller 210 is configured to send a signal to the engine 50 to operate at a first engine speed set point when entering and/or during the first mode of operation (e.g., engaging the pump clutch 70, turning the UHP pumping system 100 on, in response to neither the turret 180 nor the hose reel 190 discharging fluid, idle operation, etc.). In one embodiment, the first engine speed set point is approximately 800 revolutions-per-minute ("RPM"). In other embodiments, the first engine speed set point is greater than or less than 800 RPM (e.g., 900 RPM, 750 RPM, based on the respective engine 50, etc.).

According to an exemplary embodiment, the controller 210 is configured to send a signal to the engine 50 to operate at a second engine speed set point during the first mode of operation in response to the flow switch 192 indicating that the hose reel 190 is discharging fluid. In one embodiment, the second engine speed set point is approximately 1800 RPM. In other embodiments, the second engine speed set point is greater than or less than 1800 RPM (e.g., 1900, 1700 RPM, 1250 RPM, based on the respective engine 50 and UHP pumping system 100, etc.). The second engine speed set point may be selected to provide the fluid flow to the hose reel 190 at a target pressure of 1100 psi and a target flow rate of 20 gpm. In other embodiments, the second engine speed set point is different to provide a different target pressure and/or target flow rate to the hose reel 190.

According to an exemplary embodiment, the controller 210 is configured to send a signal to the engine 50 to operate at a third engine speed set point during the first mode of operation in response to an operator providing an input to the user interface 220 to discharge fluid via the turret 180 (e.g., using a trigger on the turret joystick 226, etc.). In one embodiment, the third engine speed set point is approximately 2000 RPM. In other embodiments, the third engine speed set point is greater than or less than 2000 RPM (e.g., 2100 RPM, 1900 RPM, based on the respective engine 50 and UHP pumping system 100, etc.). The third engine speed set point may be selected to provide the fluid flow to the turret 180 at a target pressure of 1250 psi and a target flow rate of 300 gpm. In other embodiments, the third engine speed set point is different to provide a different target pressure and/or target flow rate to the turret 180.

According to an exemplary embodiment, the controller 210 is configured to send a signal to the engine 50 to operate at a fourth engine speed set point during the first mode of operation in response to the flow switch 192 indicating that the hose reel 190 is discharging fluid and an operator providing an input to the user interface 220 to discharge fluid via the turret 180. In one embodiment, the fourth engine speed set point is approximately equal (e.g., within 50 RPM, etc.) to the third engine speed set point. In other embodiments, the fourth engine speed set point is greater than the third engine speed set point. The fourth engine speed set point may be selected to provide the fluid flow to the hose reel 190 at a target pressure of 1100 psi and a target flow rate of 20 gpm and to the turret 180 at a target pressure of 1250 psi and a target flow rate of 300 gpm. In other embodiments, the fourth engine speed set point may be different to provide a different target pressure and/or target flow rate to the hose reel 190 and/or the turret 180.

According to an exemplary embodiment, the controller 210 is configured to send a signal to the engine 50 to operate at a fifth engine speed set point during the first mode of operation to manage transient conditions (e.g., discharging from the turret 180 and then discharging from hose reel 190 concurrently, discharging from the hose reel 190 and then discharging from the turret 180 concurrently, switching between discharging fluid and not discharging fluid, etc.). The fifth engine speed set point may be selected to protect valve seats for maximum durability during the transient conditions. In one embodiment, the fifth engine speed set point is approximately 1200 RPM. In other embodiments, the fifth engine speed set point is greater than or less than 1200 RPM (e.g., 1300 RPM, 1100 RPM, based on pumping requirements, based on the valve seats, etc.). By way of example, the controller 210 may operate the engine 50 at the second engine speed set point (e.g., when the hose reel 190 is discharging, etc.), and an operator may thereafter desire to concurrently discharge from the turret 180 (e.g., indicated by the operator providing a user input using the turret joystick 226, etc.). In response, the controller 210 may send a signal to the engine 50 to operate at the fifth engine speed set point for a period of time (e.g., three seconds, five seconds, etc.) and thereafter send a signal to the engine 50 to operate the engine 50 at the fourth engine speed set point. By way of another example, the controller 210 may operate the engine 50 at the third engine speed set point (e.g., when the turret 180 is discharging, etc.), and an operator may thereafter desire to concurrently discharge from the hose reel 190. In response, the controller 210 may send a signal to the engine 50 to operate at the fifth engine speed set point for a period of time (e.g., three second, five second, etc.) and thereafter send a signal to the engine 50 to operate the engine 50 at the fourth engine speed set point.

According to an exemplary embodiment, the controller 210 is configured to regulate engine torque and/or power of the engine 50 during the first mode of operation (e.g., crash mode, UHP mode, pump and roll mode, etc.). The engine 50 is configured to output a greater amount of torque and/or power than the transmission 60 is rated for, according to an exemplary embodiment. The controller 210 is configured to send a signal to the engine 50 to operate at a derated engine torque and/or power to protect the transmission 60 during a normal driving mode (e.g., the UHP pumping system 100 is off, etc.). According to an exemplary embodiment, the UHP pump 150 requires a substantial amount of power and torque to operate. The controller 210 is configured to remove the power and/or torque limit on the engine 50 in response to the UHP pumping system 100 being turned on such that the UHP pumping system 100 is provided with the required torque and power to meet the target output fluid pressures and flow rates. In other embodiments, the power and/or the torque limit is removed in response to the pump clutch 70 engaging, the turret 180 and/or the hose reel discharging, and/or when an accelerator pedal is pressed. Removing the power and/or torque limit further facilitates providing enough power and torque to the transmission 60 to operate the fire fighting vehicle 10 in a pump and roll mode (e.g., the first mode of operation with the fire fighting vehicle 10 moving, etc.). The controller 210 may be further configured to engage and modulate the power divider clutch 62 to regulate the ground speed (e.g., speed of the fire fighting vehicle 10, since the engine is at an engine speed set point during the first mode of operation, etc.).

In some embodiments, the controller 210 is further configured to send a signal to the agent distribution system 130 to engage and/or control an amount of agent or water-agent solution injected into the fluid flow by the agent eductor 134 (e.g., based on an operator input to start discharging the agent, based on operating characteristics of the LP pump 140, etc.).

Figure 11A:
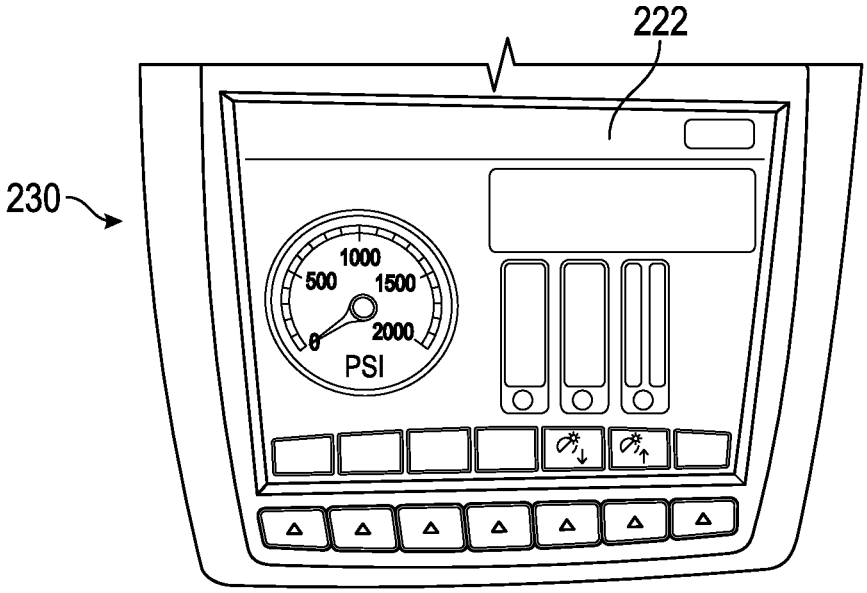
FIGS. 11A-11C are various views of graphical user interfaces providing by a display of a pumping system, according to an exemplary embodiment.
Figure 11B:
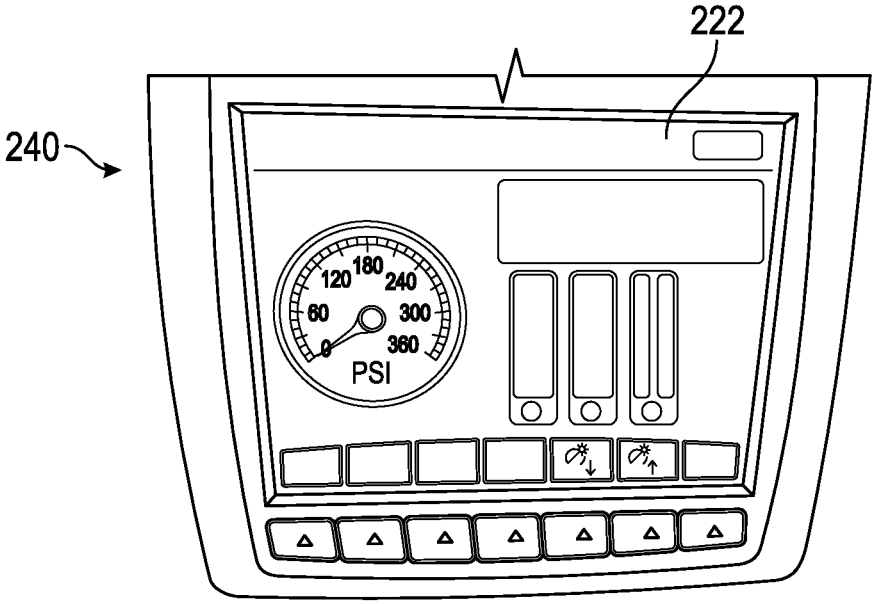
Figure 11C:
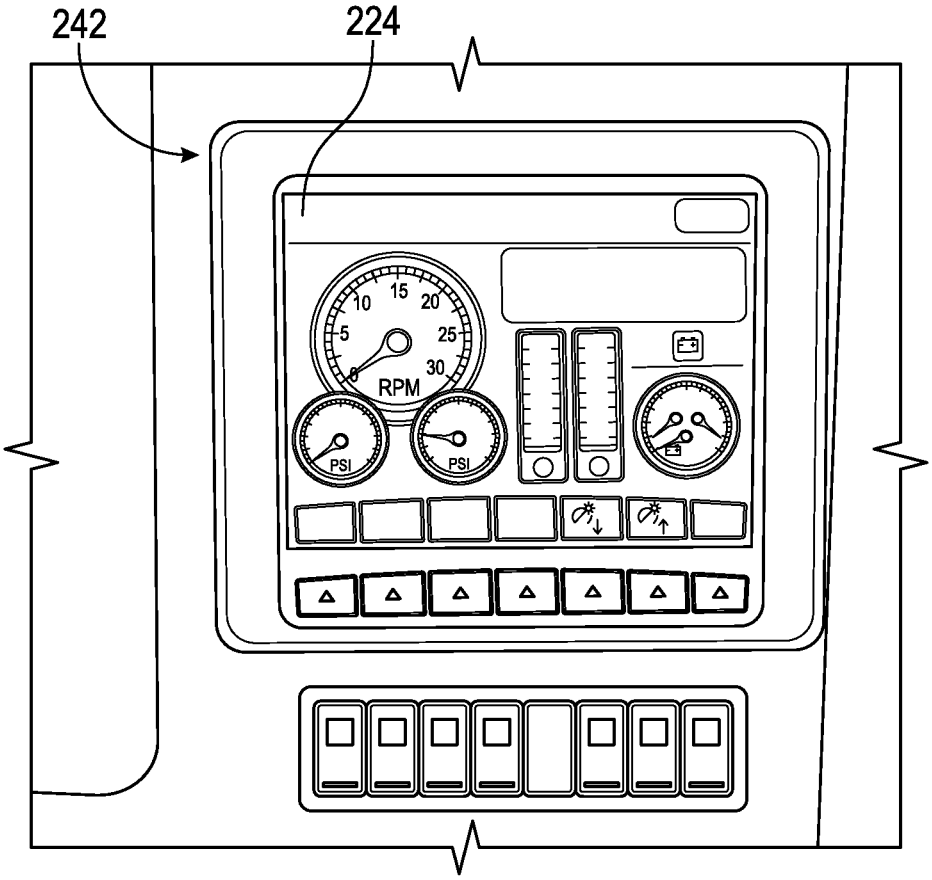

According to the exemplary embodiment shown in FIGS. 10-11C, the controller 210 is configured to send a signal to the user interface 220 to change a graphical user interface on at least one of the cabin display 222 and the side display 224 based on the mode of operation. As shown in FIG. 11A, the controller 210 may send a signal to the cabin display 222 to provide a graphical user interface, shown as high pressure interface 230, associated with the first mode of operation (e.g., in response to the first mode of operation being initiated, etc.). The high pressure interface 230 may display a pressure gauge indicating the pressure of the fluid being discharged from the turret 180 and/or the hose reel 190 (e.g., 1500 psi, 2000 psi, etc.). The high pressure interface 230 may further provide an indication of component faults, water levels within the water tank 110, agent levels within the agent tank 120, and/or other system information. While, as shown in FIGS. 11B-11C, the controller 210 may send a signal to the cabin display 222 and/or the side display 224 to provide a graphical user interface, shown as low pressure interface 240 and low pressure interface 242, respectively, associated with the second mode of operation (e.g., in response to the second mode of operation being initiated, etc.). The low pressure interface 240 and the low pressure interface 242 may display a pressure gauge indicating the pressure of the fluid being discharged from the structural discharge 170 (e.g., 360 psi, 250 psi, etc.). The low pressure interface 240 and the low pressure interface 242 may further provide an indication of component faults, water levels within the water tank 110, agent levels within the agent tank 120, and/or other system information. In some embodiments, the low pressure interface 242 of the side display 224 includes additional information that the low pressure interface 240 of the cabin display 222 does not. By way of example, the low pressure interface 242 may further include a display of a speed of the LP pump 140, battery energy levels, oil temperature, and/or oil level.

Figure 12:
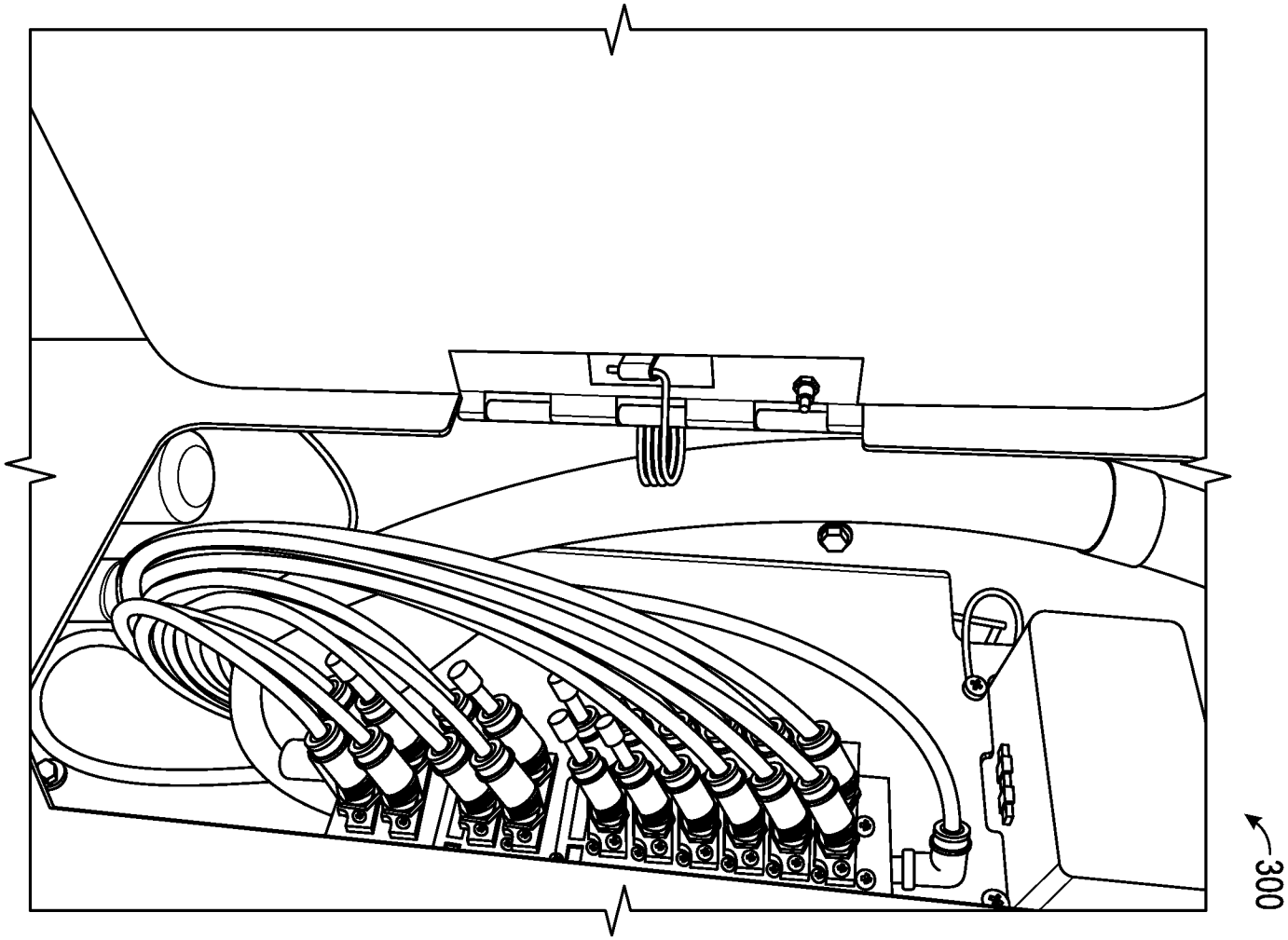
FIG. 12 is a detailed view of manual back up controls for a pumping system, according to an exemplary embodiment.

As shown in FIG. 12, the fire fighting vehicle 10 includes controls, shown as manual back up controls 300. By way of example, an operator of the fire fighting vehicle 10 may access the manual back up controls 300 to manually engage, disengage, or otherwise control various components of the UHP pumping system 100. For example, the turret 180 may be manually operated (e.g., during a fault condition, etc.) by manually overriding the control of the turret 180 (e.g., since the controller 210 and the turret joystick 226 operate the turret 180, etc.) using the manual back up controls 300.

As utilized herein, the terms "approximately", "about", "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like, as used herein, mean the joining of two members directly or indirectly to one another. Such joining may be stationary (e.g., permanent, etc.) or moveable (e.g., removable, releasable, etc.). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," "between," etc.) are merely used to describe the orientation of various elements in the figures. It should be noted that the orientation of various elements may differ according to other exemplary embodiments, and that such variations are intended to be encompassed by the present disclosure.

Also, the term "or" is used in its inclusive sense (and not in its exclusive sense) so that when used, for example, to connect a list of elements, the term "or" means one, some, or all of the elements in the list. Conjunctive language such as the phrase "at least one of X, Y, and Z," unless specifically stated otherwise, is otherwise understood with the context as used in general to convey that an item, term, etc. may be either X, Y, Z, X and Y, X and Z, Y and Z, or X, Y, and Z (i.e., any combination of X, Y, and Z). Thus, such conjunctive language is not generally intended to imply that certain embodiments require at least one of X, at least one of Y, and at least one of Z to each be present, unless otherwise indicated.

It is important to note that the construction and arrangement of the lateral access limitation system as shown in the exemplary embodiments is illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements. It should be noted that the elements and/or assemblies of the components described herein may be constructed from any of a wide variety of materials that provide sufficient strength or durability, in any of a wide variety of colors, textures, and combinations. Accordingly, all such modifications are intended to be included within the scope of the present inventions. Other substitutions, modifications, changes, and omissions may be made in the design, operating conditions, and arrangement of the preferred and other exemplary embodiments without departing from scope of the present disclosure or from the spirit of the appended claims.

The invention claimed is:

1. A fluid delivery system for a fire fighting vehicle, the fluid delivery system comprising:

a low pressure discharge;

a low pressure pump having an inlet positioned to receive a fluid from a fluid tank and an outlet fluidly coupled to the low pressure discharge;

a high pressure pump having an inlet fluidly coupled to the outlet of the low pressure pump such that the low pressure pump and the high pressure pump are arranged in a serial configuration;

a turret coupled to an outlet of the high pressure pump;

a hose reel coupled to the outlet of the high pressure pump;

a clutch positioned to facilitate selectively coupling the high pressure pump to the engine; and a controller coupled to the clutch;

wherein the fluid delivery system is selectively reconfigurable between a first mode of operation and a second mode of operation;

wherein the low pressure pump provides a first fluid output (i) to the high pressure pump during the first mode of operation and (ii) to the low pressure discharge during the second mode of operation;

wherein the high pressure pump receives the first fluid output from the low pressure pump and provides a second fluid output that has a higher pressure than the first fluid output to at least one of the turret and the hose reel during the first mode of operation;

wherein the controller engages the clutch to selectively couple the high pressure pump to the engine in response to the fluid delivery system being operated in the first mode of operation such that the at least one of the turret and the hose reel receive the second fluid output; and wherein the controller disengages the clutch to selectively decouple the high pressure pump from the engine in response to the fluid delivery system being operated in the second mode of operation such that the turret and the hose reel do not receive the second fluid output, but the low pressure discharge receives the first fluid output.

2. A fluid delivery system for a fire fighting vehicle, the fluid delivery system comprising:

a low pressure discharge;

a low pressure pump having an inlet configured to receive a fluid from a fluid tank and an outlet coupled to the low pressure discharge;

a high pressure pump having an inlet coupled to the outlet of the low pressure pump such that the low pressure pump and the high pressure pump are arranged in a serial configuration, wherein the high pressure pump is configured to be selectively driven by an engine of the fire fighting vehicle; and a turret coupled to an outlet of the high pressure pump;

a hose reel coupled to the outlet of the high pressure pump; and a controller;

wherein the fluid delivery system is selectively reconfigurable between a first mode of operation and a second mode of operation;

wherein the low pressure pump provides a first fluid output (i) to the high pressure pump during the first mode of operation and (ii) to the low pressure discharge during the second mode of operation;

wherein the high pressure pump receives the first fluid output from the low pressure pump and provides a second fluid output that has a higher pressure than the first fluid output to at least one of the turret and the hose reel during the first mode of operation; and wherein, during the first mode of operation, the controller:

operates the engine at a first set point in response to receiving a first discharge signal associated with discharging the second fluid output from the turret;

operates the engine at a second set point that is less than the first set point in response to receiving a second discharge signal associated with discharging the second fluid output from the hose reel; and operates the engine at a third set point that is greater than the second set point in response to receiving both the first discharge signal and the second discharge signal.

3. The fluid delivery system of claim 2, further comprising the fluid tank, wherein the fluid tank includes at least one of a water tank configured to store water and an agent tank configured to store an agent.

4. The fluid delivery system of claim 3, the fluid tank comprising the agent tank configured to store the agent, further comprising an agent distribution system coupled to the low pressure pump and the agent tank, wherein the agent distribution system is configured to regulate an amount of the agent within the fluid provided to the low pressure pump.

5. The fluid delivery system of claim 2, wherein the low pressure discharge includes a structural discharge.

6. The fluid delivery system of claim 2, further comprising a user interface coupled to the controller and configured to receive a discharge input from an operator of the fire fighting vehicle to discharge the second fluid output from the turret, wherein the user interface is configured to provide the first discharge signal to the controller in response to receiving the discharge input.

7. The fluid delivery system of claim 6, further comprising a flow sensor coupled to the controller and configured to provide the second discharge signal relating to a flow of the second fluid output through the hose reel.

8. The fluid delivery system of claim 7, wherein the controller operates the engine at a fourth set point that is different than the first set point, the second set point, and the third set point for a period of time during a transition from discharging the second output fluid from one of the turret and the hose reel to both the turret and the hose reel.

9. The fluid delivery system of claim 2, wherein the controller is further configured to provide an output relating to an operating characteristic of the engine based on a fluid discharge condition of the at least one of the turret and the hose reel.

10. The fluid delivery system of claim 9, wherein the fluid discharge condition includes a flow rate, further comprising a flow sensor coupled to the controller and configured to provide a signal relating to the flow rate associated with the at least one of the turret and the hose reel.

11. The fluid delivery system of claim 9, wherein the fluid discharge condition includes a discharge input, further comprising a user interface coupled to the controller and configured to receive the discharge input from an operator of the fire fighting vehicle to discharge the fluid from the at least one of the turret and the hose reel.

12. The fluid delivery system of claim 11, wherein the controller is configured to selectively couple the high pressure pump to the engine in response to the discharge input.

13. The fluid delivery system of claim 2, further comprising a relief system positioned to regulate fluid pressure between (i) the low pressure pump and (ii) the high pressure pump and the low pressure discharge, wherein the relief system is configured to regulate the pressure at the outlet of the low pressure pump to a target pressure such that the fluid is provided at the low pressure discharge and the high pressure pump at the target pressure.

14. The fluid delivery system of claim 2, wherein the controller is configured to prevent the fluid delivery system from being operated in the second mode unless the fire fighting vehicle is determined to be in a parked configuration.

* * * * *